US010697278B2

(12) United States Patent
Elmer

(10) Patent No.: US 10,697,278 B2
(45) Date of Patent: Jun. 30, 2020

(54) GAS COMPRESSION SYSTEM FOR WELLBORE INJECTION, AND METHOD FOR OPTIMIZING INTERMITTENT GAS LIFT

(71) Applicant: Encline Artificial Lift Technologies LLC, Houston, TX (US)

(72) Inventor: William G. Elmer, Tyler, TX (US)

(73) Assignee: Encline Artificial Lift Technologies LLC, Houston, TX (US)

( * ) Notice: Subject to any disclaimer, the term of this patent is extended or adjusted under 35 U.S.C. 154(b) by 239 days.

(21) Appl. No.: 15/839,438

(22) Filed: Dec. 12, 2017

(65) Prior Publication Data

US 2018/0171765 A1 Jun. 21, 2018

Related U.S. Application Data

(60) Provisional application No. 62/436,608, filed on Dec. 20, 2016.

(51) Int. Cl.
*E21B 43/12* (2006.01)
*E21B 43/34* (2006.01)

(52) U.S. Cl.
CPC ..... *E21B 43/123* (2013.01); *E21B 43/34* (2013.01)

(58) Field of Classification Search
CPC .... E21B 43/122; E21B 43/123; E21B 43/121; E21B 43/34; E21B 34/08; E21B 34/16;
(Continued)

(56) References Cited

U.S. PATENT DOCUMENTS 3,191,681 A 6/1965 Hubby
4,708,595 A 11/1987 Maloney et al.
(Continued)

FOREIGN PATENT DOCUMENTS

WO WO-2016084058 A1 * 6/2016 ..... E21B 43/128

OTHER PUBLICATIONS

B. Jansen, et al., "Automatic Control of Unstable Gas Lifted Wells," PE 56832 (Oct. 1999).

(Continued)

*Primary Examiner* — David Carroll
(74) *Attorney, Agent, or Firm* — Peter L. Brewer; Thrive IP

(57) ABSTRACT

A gas injection optimization system is provided. The optimization system is designed to control a volume of gas injected into a wellbore in connection with an intermittent gas-lift system. The system includes a gas storage vessel residing at the surface, and a series of pressure transducers. The system additionally includes a controller configured to receive pressure value signals from the transducers, and in response, send control signals that cyclically open and close a well flow control valve at the surface. When the well flow control valve is closed, compressible fluid is injected into the gas storage vessel to load the vessel. When the well flow control valve is opened, a volume of injection gas ($V_R$) is released from the vessel and is injected into a wellbore annular region to push a volume of fluids ($V_S$) residing in the tubing string to the surface. A method for optimizing gas injection into a wellbore in support of an intermittent gas-lift operation is also provided herein.

34 Claims, 9 Drawing Sheets

(58) Field of Classification Search
CPC ..... E21B 34/166; E21B 34/168; F04F 1/08; F04F 1/20
See application file for complete search history.

(56) References Cited

U.S. PATENT DOCUMENTS

| | | | | |
|---|---|---|---|---|
| 4,711,306 | A | 12/1987 | Bobo | |
| 4,898,235 | A | 2/1990 | Enright | |
| 5,671,813 | A | 9/1997 | Lima | |
| 5,735,346 | A | 4/1998 | Brewer | |
| 6,182,756 | B1 | 2/2001 | Garcia et al. | |
| 6,296,052 | B1 * | 10/2001 | Sidwell | E21B 43/122 166/250.15 |
| 6,352,109 | B1 | 3/2002 | Buckman, Sr. | |
| 7,299,873 | B2 | 11/2007 | Hartman et al. | |
| 7,373,972 | B2 | 5/2008 | Ocalan | |
| 8,069,921 | B2 | 12/2011 | Garcia et al. | |
| 8,162,060 | B2 | 4/2012 | Randazzo | |
| 8,469,107 | B2 | 6/2013 | O'Malley | |
| 8,794,305 | B2 | 8/2014 | Wilson | |
| 9,297,247 | B2 | 3/2016 | Lea, Jr. | |
| 9,322,251 | B2 | 4/2016 | Mazzanti | |
| 9,435,163 | B2 | 9/2016 | Wilson | |
| 2003/0173276 | A1 * | 9/2003 | Arnaud | B01D 21/2433 210/143 |
| 2007/0275471 | A1 * | 11/2007 | Coward | E21B 43/00 436/55 |
| 2014/0305652 | A1 * | 10/2014 | Wilson | E21B 43/123 166/311 |
| 2016/0340998 | A1 * | 11/2016 | Holmes | E21B 33/063 |
| 2017/0356279 | A1 * | 12/2017 | Nandola | E21B 43/128 |

OTHER PUBLICATIONS

J. Cahill, "Maximizing Production Through Optimized Gas Lifting," https://www.emersonprocessxperts.com/2016/02/maximizing-production-optimized-gas-lifting/ (Feb. 2016).
R.E. Moffett, et al., "Real Gas Lift Optimization," SPE 188480 (Nov. 2017).
J. Correa, "Intelligent Automation for Intermittent Gas Lift," SPE 69404 (Mar. 2001).
A. Hernandez, et al., "Intermittent Gas Lift Optimization," SPE 53968 (Apr. 1999).
Schlumberger, "Pilot-Operated Gas Lift Valves," www.slb.com/~/media/Files/artificial_lift/product_sheets/gas-lift/pilotop.pdf (Jan. 2015).
O. Bellow, et al., "Modeling the Performance of a Plunger-Assisted Intermittent Gas-Lift System," SPE 141251 (Mar. 2011).
K. Bybee, "Combining Plunger Lift and Gas Injection," JPT Article (Nov. 2006).
R. Schmitz, "The Tools, Techniques, and Advantages Involved," SPE 100590 (May 2006).
M. Walker, Intermittent Injection of Gas in Gas-lift Installations, Amerada Petr. Corp. (Oct. 1928).
M. Young, "Intermittent Gas Lift Utilizing a Pilot Valve," 39th Gas-Lift Workshop (May 2016).

* cited by examiner

GAS COMPRESSION SYSTEM FOR WELLBORE INJECTION, AND METHOD FOR OPTIMIZING INTERMITTENT GAS LIFT

CROSS REFERENCE TO RELATED APPLICATIONS

This application claims the benefit of U.S. Ser. No. 62/436,608 filed Dec. 20, 2016. That application is entitled "Gas Compression System For Wellbore Injection, and Method For Optimizing Intermittent Gas Lift," and is incorporated herein in its entirety by reference.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

BACKGROUND OF THE INVENTION

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

FIELD OF THE INVENTION

The present disclosure relates to the field of hydrocarbon recovery operations. More specifically, the present invention relates to a gas compression system to support artificial lift for a wellbore, and methods for optimizing the injection of compressible fluids into a well to assist the lift of production fluids to the surface. The invention also relates to controlled intermittent gas-lift operations for a wellbore.

Technology in the Field of the Invention

In the drilling of oil and gas wells, a wellbore is formed using a drill bit that is urged downwardly at a lower end of a drill string. The drill bit is rotated while force is applied through the drill string and against the rock face of the formation being drilled. After drilling to a predetermined depth, the drill string and bit are removed and the wellbore is lined with a string of casing.

In completing a wellbore, it is common for the drilling company to place a series of casing strings having progressively smaller outer diameters into the wellbore. These include a string of surface casing, at least one intermediate string of casing, and a production casing. The process of drilling and then cementing progressively smaller strings of casing is repeated until the well has reached total depth. In some instances, the final string of casing is a liner, that is, a string of casing that is not tied back to the surface. The final string of casing, referred to as a production casing, is also typically cemented into place.

To prepare the wellbore for the production of hydrocarbon fluids, a string of tubing is run into the casing. A packer is optionally set at a lower end of the tubing to seal an annular area formed between the tubing and the surrounding strings of casing. The tubing then becomes a string of production pipe through which hydrocarbon fluids flow from the reservoir and up to the surface.

Some wellbores are completed primarily for the production of gas (or compressible hydrocarbon fluids), as opposed to oil. Other wellbores initially produce hydrocarbon fluids, but over time transition to the production of gas. In either of such wellbores, the formation will frequently produce fluids in both gas and liquid phases. Liquids may include water, oil and condensate. At the beginning of production, the formation pressure is typically capable of driving the liquids with the gas up the wellbore and to the surface. Liquid fluids will travel up to the surface with the gas primarily in the form of entrained droplets.

During the life of the well, the natural reservoir pressure will decrease as gases and liquids are removed from the formation. As the natural downhole pressure of the well decreases, the gas velocity moving up the well drops below a so-called critical flow velocity. See G. Luan and S. He, *A New Model for the Accurate Prediction of Liquid Loading in Low-Pressure Gas Wells*, Journal of Canadian Petroleum Technology, p. 493 (November 2012) for a recent discussion of mathematical models used for determining critical gas velocity in a wellbore. In addition, the hydrostatic head of fluids in the wellbore will work against the formation pressure and block the flow of in situ gas into the wellbore. The result is that formation pressure is no longer able, on its own, to force fluids from the formation and up the production tubing in commercially viable quantities.

In response, various remedial measures have been taken by operators. For example, operators have sought to monitor tubing pressure through the use of pressure gauges and orifice plates at the surface. U.S. Pat. No. 5,636,693 entitled "Gas Well Tubing Flow Rate Control," issued in 1997, disclosed the use of an orifice plate and a differential pressure controller at the surface for managing natural wellbore flow up more than one flow conduit. The '693 patent is incorporated herein in its entirety by reference.

U.S. Pat. No. 7,490,675, entitled "Methods and Apparatus for Optimizing Well Production," also proposed the use of an orifice plate and a differential pressure controller to operate a control valve at the surface. This is in the context of a plunger lift system. The '675 patent issued in 2009 and is also incorporated by reference herein.

A common technique for artificial lift in both oil and gas wells remains the gas-lift system. Gas lift refers to a process wherein a gas (typically methane, ethane, propane, nitrogen and other produced gases) is injected into the wellbore downhole to reduce the density of the fluid column. Injection is sometimes done through so-called gas-lift valves stacked vertically along the production tubing within the annulus. The injection of gas into the annulus, then through the valves, and then into the production tubing lightens the density of the wellbore fluids and decreases the backpressure against the formation.

With the advent of the horizontal oil shale boom, gas lift systems have enjoyed a resurgence as an artificial lift technique. This is primarily because of the ability of gas lift systems to manage entrained solids such as frac sand and scale. This is also because gas-lift wells do not experience the mechanical limitations that beam lift and electric submersible lift wells experience with non-vertical wells. Incidentally, gas lift is also popular for lifting oil wells in large fields or offshore facilities, as both the gas source and the power station may be remotely located from the wells.

Gas lift does have a disadvantage relative to mechanical artificial lift processes in that it is generally unable to reduce flowing bottom hole pressure to a desired level prior to abandoning reservoirs. Instead, gas is supplied through various gas lift valves disposed vertically along the tubing. In addition, gas lift systems are designed to inject gas into the tubing-casing annulus continuously and at the same rate regardless of fluctuations in fluid density within the wellbore or hydrostatic head in the tubing. For gas lift operations, the injection rate is set by the operator at a continuous high level to ensure that fluids can travel to the surface, without regard to fluctuations in fluid densities or tubing pressure. Thus, the gas lift system is "tuned" to a worst case scenario.

In order to obtain a lower flowing bottom hole pressure, and to reduce the amount of lift gas required, a specialized form of artificial lift has been developed. This is known as "intermittent gas lift."

Intermittent gas-lift allows fluid pressure to build on a back side of the tubing string, in the annulus. Once the pressure reaches a designated level, a single (normally-closed) pilot valve placed at the bottom of the tubing string opens, allowing the gas to bleed off into the production string. This reduces fluid density in the production string relatively quickly, e.g., five minutes, allowing formation fluids to flow more readily to the surface for a period of time. However, even intermittent gas lift involves a more or less continuous injection of gas from the surface and into the annulus, where gas accumulates under pressure until the pilot valve opens. Upon release from the annulus, gas is pushed into the tubing string to push a slug of fluid residing in the tubing string up the hole quickly.

It is noted that with intermittent gas lift, the volume of gas released is substantially the same regardless of the amount or density of fluid present in the production tubing at a given time. This means that the amount of gas released into the tubing string will not always be appropriate, particularly in the case of horizontal wells that tend to experience cyclical build-ups of gas followed by bursts of liquids. This phenomenon is known as fluid slugging.

Moreover, an intermittent gas-lift valve needs to be periodically "tuned" to pressure set points at which the normally-closed valve will open. In this respect, the valve will open in response to fluid accumulation on the back side of the casing, and then close in response to a release of the gas into the tubing string and corresponding draw-down in annular pressure. Operators charge for the service of pulling the valve and readjusting the pressure sensors or settings periodically as formation pressure and well productivity decline. In any instance, intermittent gas lift systems are also "tuned" to the worst case scenario.

A system and method are needed that allow injection gas volumes to be adjusted in substantially real time to accommodate variations in the fluid column (or height of the fluid slug) within the tubing string. A need also exists for an intermittent gas-lift system wherein the pilot valve essentially operates at the surface rather than at the bottom of the production tubing, thereby eliminating the need to pull the pilot valve to "tune" the pressure set points over time. Finally, a method is needed for adjusting gas flowrates for gas lift to a well operator's desired set point based on measured differential pressure without need of pulling a gas-lift valve or making periodic adjustments to a pilot valve that resides downhole.

BRIEF SUMMARY OF THE DISCLOSURE

A gas injection optimization system is first provided herein. The gas injection optimization system is designed to operate at a well site. In one aspect, the optimization system is designed to control a volume of gas injection in connection with an intermittent gas-lift system in a wellbore. In another aspect, the optimization system is self-tuning, and can control the volume of gas injected into a wellbore annulus in support of gas lift in response to changing wellbore conditions.

The gas injection optimization system first includes a string of production tubing. The tubing string resides within a wellbore. The tubing string extends from a surface, and down to a selected subsurface formation. Of interest, the tubing string need not and preferably does not have a pilot valve or other gas lift valve.

The system also includes an annular region. The annular region resides around the tubing string, and also extends down into the wellbore and to the subsurface formation. Preferably, the annular region is open, that is, it is not sealed off by a packer. However, the system can be adjusted to work with a closed annular region as well. Alternatively, a small check valve may be placed within the packer that allows gas to pass through the packer en route to the bottom of the production tubing.

The system also comprises a production line at the surface. The production line is in fluid communication with the tubing string and delivers produced fluids from the well for processing.

The system further comprises a gas storage vessel. The gas storage vessel comprises a high pressure vessel that resides at the surface. The gas storage vessel has an input line for receiving a compressible fluid, and an outlet line for delivering the compressible fluid under pressure into the annular region as an injection gas.

The system additionally includes a gas injection line. The gas injection line is in communication with the outlet line, and is configured to inject the compressible fluid from the gas storage vessel into the annular region, that is, the back side of the tubing.

The system further includes a series of pressure transducers. A first transducer detects pressure in the annular region, or tubing-casing annulus; a second transducer detects pressure in the tubing string; and a third transducer detects pressure in the gas storage vessel itself. These transducers are all located conveniently at the surface.

The system further includes a well flow control valve. The well flow control valve is in fluid communication with the outlet line for the gas storage vessel. The well flow control valve cycles between open and closed positions in response to control settings.

The system additionally includes a controller. The controller is configured to control the injection of the compressible fluid into the annular region. Specifically, the controller is configured to receive pressure value signals from the first pressure transducer, the second pressure transducer and the third pressure transducer, and in response, send control signals that cyclically open and close the well flow control valve. When the well flow control valve is closed, compressible fluid is directed through the input line to pressurize the gas storage vessel. When the well flow control valve is open, injection gas exits the outlet line, flows through the gas injection line and the well flow control valve, and is injected into the annular region as a "burst" of gas. Thus, an intermittent gas lift system is provided that is controlled in real time from the surface.

As a result of the operation of the controller, the injection system cycles between a fluid in-flow stage wherein the high pressure storage vessel is loaded with gas, and a fluid release stage wherein the storage vessel releases gas into the gas injection line and then into the annular region. In one aspect of the invention, the controller infers a volume of liquid residing in the tubing string based on differential pressure (ΔP) between the tubing string and the surrounding casing. Based upon the known tubular geometries in the wellbore, the controller then determines how much compressible fluid should be loaded into the gas storage vessel before release. The greater the ΔP, the greater the fluid volume ($V_S$) (or height of a fluid slug) exists in the tubing string. In turn, the greater the fluid volume ($V_S$), the greater the volume of gas ($V_R$) that should be accumulated into the gas storage vessel before release.

The gas injection optimization system further comprises a compressor. The compressor is configured to pump compressible fluid through the input line and into the gas storage vessel. The compressor may be a dedicated variable speed compressor that resides at a well site for the wellbore. In this instance, the controller may be further configured to send command signals to the compressor to adjust an operational speed to control the fill rate of the compressible fluid into the high pressure gas storage vessel at the surface. In another aspect, the compressor is a facilities compressor that resides remote from a well site for the wellbore and is configured to deliver gas to a plurality of high pressure gas injection lines. In this instance, the system further comprises a vessel in-flow control valve, with the controller being configured to send command signals to the vessel in-flow control valve to adjust an opening in the in-flow control valve. This, in turn, adjusts the fill rate of fluids from the compressor facility and into the storage vessel at the well site. In either instance, the volume of gas in the gas storage vessel is inferred in real time based upon pressure readings from the associated transducer on the gas storage vessel.

Beneficially, the gas injection optimization system autotunes itself during operation to ensure that an adequate amount of gas ($V_R$) is loaded into the high pressure storage vessel before release. Reciprocally, the system provides that an excess of gas ($V_R$) is not injected. This is done by monitoring differential pressure (ΔP) values as between tubing pressure and casing pressure during production.

In addition, the gas injection optimization system autotunes a rate of fillage for the high pressure storage vessel. This ensures that a sufficient amount of gas is available in the vessel when (ΔP) readings suggest it is time to release gas into the annular region. If (ΔP) remains too high during a gas release (or injection) stage, the system adjusts itself to increase ($V_R$) (by increase the fillage rate) during a next vessel loading stage.

A method of optimizing gas injection for an intermittent gas lift system is also provided herein. The method employs the gas injection optimization system as described above, in its various embodiments. Preferably, the gas injection optimization system is associated with a wellbore that is horizontally completed to help overcome a problem of slug flow.

The method first includes providing a wellbore. The wellbore has been formed for the purpose of producing hydrocarbon fluids to the surface in commercially viable quantities. Preferably, the well primarily produces hydrocarbon fluids that are compressible at surface conditions, e.g., methane, ethane, propane and/or butane.

The method next includes associating a gas compressor with the wellbore. The gas compressor may be an on-site (or well-site) compressor. Alternatively, the gas compressor may be a remote (or facilities) compressor that supplies gas to a plurality of wells in a field through high pressure gas service lines.

The method also includes producing hydrocarbon fluids through a production tubing in the wellbore, and up to the surface. An annular region is formed between the production tubing and a surrounding casing string within the wellbore.

The method additionally includes providing a gas storage vessel at the surface. The gas storage vessel is configured to hold a volume of compressible fluid, under pressure, that serves as an injection gas. The gas storage vessel is configured to continuously receive gas through an input line during a fluid in-flow (or loading) stage, and then release gas from an outlet line as ($V_R$) into the annular region during a fluid release (or injection) stage. In one aspect, ($V_R$) is tuned to lighten a column of liquid ($V_S$), that is, reduce the density of the liquid ($V_S$), residing in the production tubing. More preferably, ($V_R$) is tuned to provide sufficient pressure during the release stage to flush liquids ($V_S$) from the tubing string. Thus, the gas storage vessel serves as an inexpensive substitute for a pilot valve.

In one embodiment, a well flow control valve is provided between the gas storage vessel and a gas injection line. The well flow control valve is preferably placed along, or is otherwise in fluid communication with, the gas outlet line of the storage vessel and resides at the surface. In addition, a controller is provided that controls the volume of gas ($V_R$) being intermittently injected through the well flow control valve and the gas injection line into the wellbore annulus.

Preferably, the method is conducted through use of an on-site controller. In one embodiment, the method includes providing a first pressure transducer associated with the gas storage vessel. The method then includes the controller receiving signals ($S_1$) from the first pressure transducer in real time, and associating the signals ($S_1$) with the gas volume ($V_R$) within the gas storage vessel. This means that the controller knows the volume of gas within the storage vessel at any given time based on pressure readings.

Preferably, the controller is configured to also receive pressure value signals ($S_2$) from a second pressure transducer. The second pressure transducer is associated with the tubing string. The controller is further configured to receive pressure value signals ($S_3$) from a third pressure transducer, which is associated with the annular region (or casing string). Differential pressure calculations are made representing the difference between pressure readings of the second pressure transducer ($S_2$) and the third pressure transducer ($S_3$), representing (ΔP). Continuous ΔP calculations may be made by deducting ($S_2$) from ($S_3$) in real time.

In response to receiving the pressure signals and determining (ΔP), control signals are sent to the well flow control valve to cyclically open and close the valve. When the well flow control valve is closed, compressible fluid is directed through an input line to the gas storage vessel to pressurize the vessel. As noted, pressure readings ($S_1$) made by the first pressure transducer allow the controller to infer the volume of gas present in the vessel at any time. Loading of the gas storage vessel continues, up to a pre-set critical pressure point, until a desired volume of gas ($V_R$) has been reached. When the well flow control valve is opened, injection gas ($V_R$) leaves the gas storage vessel and is injected through the well flow control valve and into the annular region at the optimized volume ($V_R$).

Inherent within the method is a pre-determination of the geometry of the annular region and of the geometry of the gas storage vessel. Also inherent within the method is a pre-determined correlation between (ΔP) and a volume of fluid ($V_S$) residing within the tubing string. Those of ordinary skill in the art will understand that a greater ΔP indicates a greater amount of liquids residing in the production tubing. Once a designated level of ΔP is reached, the volume of gas ($V_R$) is released into the annular region.

In one aspect of the method, if an on-site compressor is used, the method may include adjusting a compressor speed during the fluid in-flow (or vessel loading) stage. This may be done to either increase or decrease the fill rate. For example, compressor operating speed may be increased when a calculated (ΔP) requires that a volume of gas larger than a pre-set volume (correlated to a pre-set vessel pressure) be loaded into the gas storage vessel. Stated another way, if the production string does not appear to have been swept of fluids during a previous gas injection stage, then the fillage rate will be increased to be ready for the next injection stage. If a remote compressor is used, then a control valve is provided at the pressure vessel to control a rate of gas entering the gas storage vessel (or high pressure storage vessel) during the fluid in-flow stage. For example, the valve opening size may be increased to increase fillage rate when a calculated (ΔP) requires that a volume of gas larger than the pre-set volume (correlated to the pre-set vessel pressure) be loaded into the gas storage vessel.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

FIG. 1D-2 is another enlarged view of the packer of FIG. 1C. In this view, a gas injection tubing is provided in the annular region of the wellbore.

FIG. 2 presents a flow chart for a control system for controlling the injection of gas into a wellbore annulus. Specifically, injection volume is optimized for an intermittent gas-lift operation.

DETAILED DESCRIPTION OF CERTAIN EMBODIMENTS

Definitions

Figure 1A:
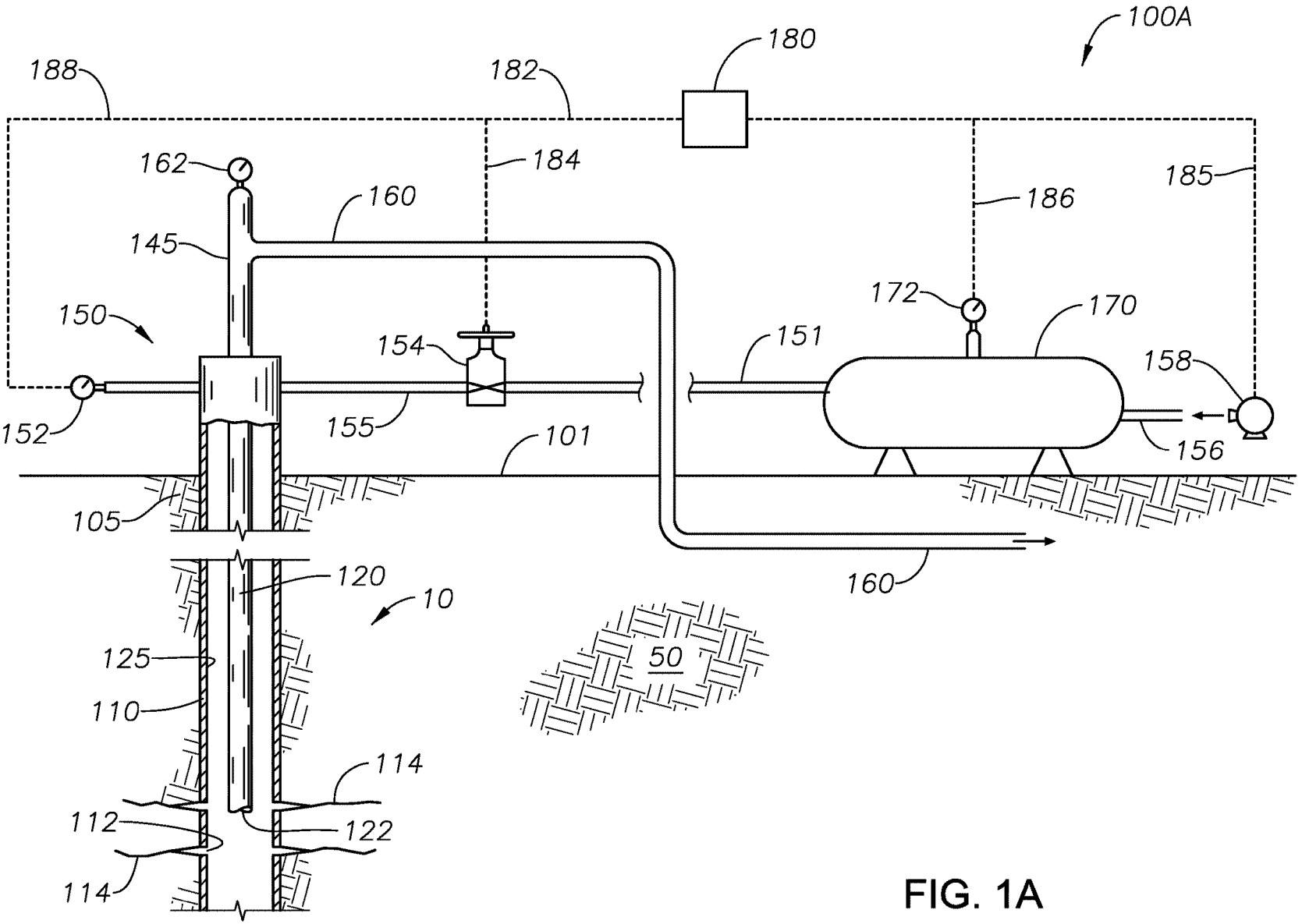
FIG. 1A is a schematic illustration of a gas injection optimization system for a wellbore, in one embodiment. The gas injection optimization system controls a volume of gas that is injected into the annular region of a wellbore to support gas lift. In this arrangement, gas injection is supplied by a dedicated wellhead gas compressor.

For purposes of the present application, it will be understood that the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at ambient condition. Hydrocarbon fluids may include, for example, oil, natural gas, coalbed methane, shale oil, pyrolysis oil, pyrolysis gas, a pyrolysis product of coal, and other hydrocarbons that are in a gaseous or liquid state, or combination thereof.

As used herein, the terms "produced fluids," "reservoir fluids" and "production fluids" refer to liquids and/or gases removed from a subsurface formation, including, for example, an organic-rich rock formation. Produced fluids may include both hydrocarbon fluids and non-hydrocarbon fluids. Production fluids may include, but are not limited to, oil, natural gas, pyrolyzed shale oil, synthesis gas, a pyrolysis product of coal, oxygen, carbon dioxide, hydrogen sulfide and water.

As used herein, the term "fluid" refers to gases, liquids, and combinations of gases and liquids, as well as to combinations of gases and solids, combinations of liquids and solids, and combinations of gases, liquids, and solids.

As used herein, the term "wellbore fluids" means water, hydrocarbon fluids, formation fluids, or any other fluids that may be within a wellbore during a production operation.

As used herein, the term "gas" refers to a fluid that is in its vapor phase. A gas may be referred to herein as a "compressible fluid." In contrast, a fluid that is in its liquid phase is an "incompressible fluid."

As used herein, the term "subsurface" refers to geologic strata occurring below the earth's surface.

As used herein, the term "formation" refers to any definable subsurface region regardless of size. The formation may contain one or more hydrocarbon-containing layers, one or more non-hydrocarbon containing layers, an overburden, and/or an underburden of any geologic formation. A formation can refer to a single set of related geologic strata of a specific rock type, or to a set of geologic strata of different rock types that contribute to or are encountered in, for example, without limitation, (i) the creation, generation and/or entrapment of hydrocarbons or minerals, and (ii) the execution of processes used to extract hydrocarbons or minerals from the subsurface.

As used herein, the term "wellbore" refers to a hole in the subsurface made by drilling or insertion of a conduit into the subsurface. A wellbore may have a substantially circular cross section. The term "well," when referring to an opening in the formation, may be used interchangeably with the term "wellbore." The term "bore" refers to the diametric opening formed in the subsurface by the drilling process.

DESCRIPTION OF SELECTED SPECIFIC EMBODIMENTS

FIG. 1A is a schematic illustration of a gas injection optimization system 100A, in one embodiment. The gas injection optimization system 100A exists for the purpose of providing gas lift in connection with the production of hydrocarbon fluids from a wellbore 10. In one aspect, the wellbore 10 produces primarily gas, with diminishing liquid production and diminishing reservoir pressure. In one aspect, produced fluids may have a GOR in excess of 500 or, more preferably, above 3,000.

The wellbore 10 defines a bore that is formed in an earth surface 101, and down to a selected subsurface formation 50. The wellbore 10 includes at least one string of casing 110 which extends from a shallow formation 105 and down proximate the subsurface formation 50. In one aspect, the casing 110 represents a string of surface casing, one or more intermediate casing strings, and a string of production casing. For illustrative purposes, only one casing string 110 is presented.

In the view of FIG. 1A, the wellbore 10 is shown as having been completed in a vertical orientation. However, it is understood that the gas injection optimization system 100A may be utilized in connection with a wellbore that has been completed in a horizontal (or other deviated) orientation. As will be realized from the discussion below, the optimization system (100A or 100B) is ideally suited for wells that have been completed horizontally, and particularly those wells that experience the phenomenon of slug flow as reservoir pressure declines.

In FIG. 1A, it is seen that the casing 110 has been perforated. Perforations are schematically shown at 112. In addition, the formation 50 has been fractured. Illustrative fractures are presented schematically at 114. Preferably, the casing 110 extends down to a lower end of the subsurface formation 50, and the perforations 112 are placed proximate or just above that lower end. In another aspect, the casing 110 has an elongated horizontal portion (not shown) with openings being provided in the casing 110 through perforating or jetting along stages of the horizontal portion within the subsurface formation 50. Of course, it is understood that the current inventions are not limited by the manner in which the casing string 110 is oriented or perforated or otherwise completed unless expressly so stated in the claims below.

The wellbore 10 has received a string of production tubing 120, sometimes referred to as a tubing string. The production tubing 120 extends from a well head 150 at the surface 101, down proximate the subsurface formation 50. The production tubing 120 conveys production fluids from the subsurface formation 50, up to the surface 101. From there, production fluids flow through a surface production pipe 145, which then tees to line 160.

In the arrangement of FIG. 1A, line 160 serves as a production line. Production fluids will be taken down the production line 160 and through one or more separators (not shown). The separator(s) will separate production fluids into compressible and incompressible components. The compressible components will represent methane, ethane, and heavier hydrocarbons in gaseous form. Some nitrogen, argon and oxygen may also be present. In addition, some sulfurous components such as hydrogen sulfide may also be produced. The incompressible components will represent any propane, butane, pentane and heavier hydrocarbons in liquid form. Some water may also be present.

The separated compressible components may be taken to a gathering facility (not shown). The facility may be, for example, a gas sweetening facility. Alternatively, the compressible components may be taken to a sales line for immediate downstream delivery where the gas meets pipeline specification standards. In the preferred arrangement, a portion of the separated compressible components is harvested for reinjection in support of a gas lift operation. In this instance, the harvested gas becomes a working gas.

Referring back to the wellbore 10, the wellbore 10 includes an annular region 125. The annular region 125 resides between the tubing string 120 and the surrounding casing string 110. Preferably, a packer (not shown) is placed at a lower end of the tubing string 120 to seal the annular region 125.

The gas injection optimization system 100A is designed to inject (or re-inject) a compressible fluid into the annular region 125 of the wellbore 10. The compressible fluid is preferably a light hydrocarbon gas, such as methane, ethane, propane, or combinations thereof. The present inventions are not limited to the type of gas injected unless expressly stated in the claims, though preferably the injected gas is composed primarily of produced gases taken from production line 160. The gas is injected in support of an intermittent gas lift system for the wellbore 10. Injection is typically at relatively low pressures, such as 150 to 500 psig.

In operation, the gas is injected through a gas injection line 155 and then into the annular region 125 as a working gas. In one aspect, gas lift valves (not shown) are placed along the production tubing 120 to facilitate injection. In another aspect, gas is injected through a pilot valve placed at a lower end of the production tubing 120. More preferably, gas is injected through a dedicated tubing, or is simply injected into the tubing-casing annulus 125 at the wellhead 150 where it flows down to the perforations 112 and back up the production tubing 120 with produced fluids. In the most preferred embodiment, no gas lift valve or pilot valve is used.

In one application, the wellbore includes a packer placed at the bottom of the production tubing 120. Where the production tubing 120 has a packer, a tube or check valve may be provided along the packer (not shown) to facilitate annular injection below the production tubing 120. For purposes of the present disclosure, the term "annular region" includes a dedicated flow line that extends down proximate the subsurface region 50.

Figure 1B:
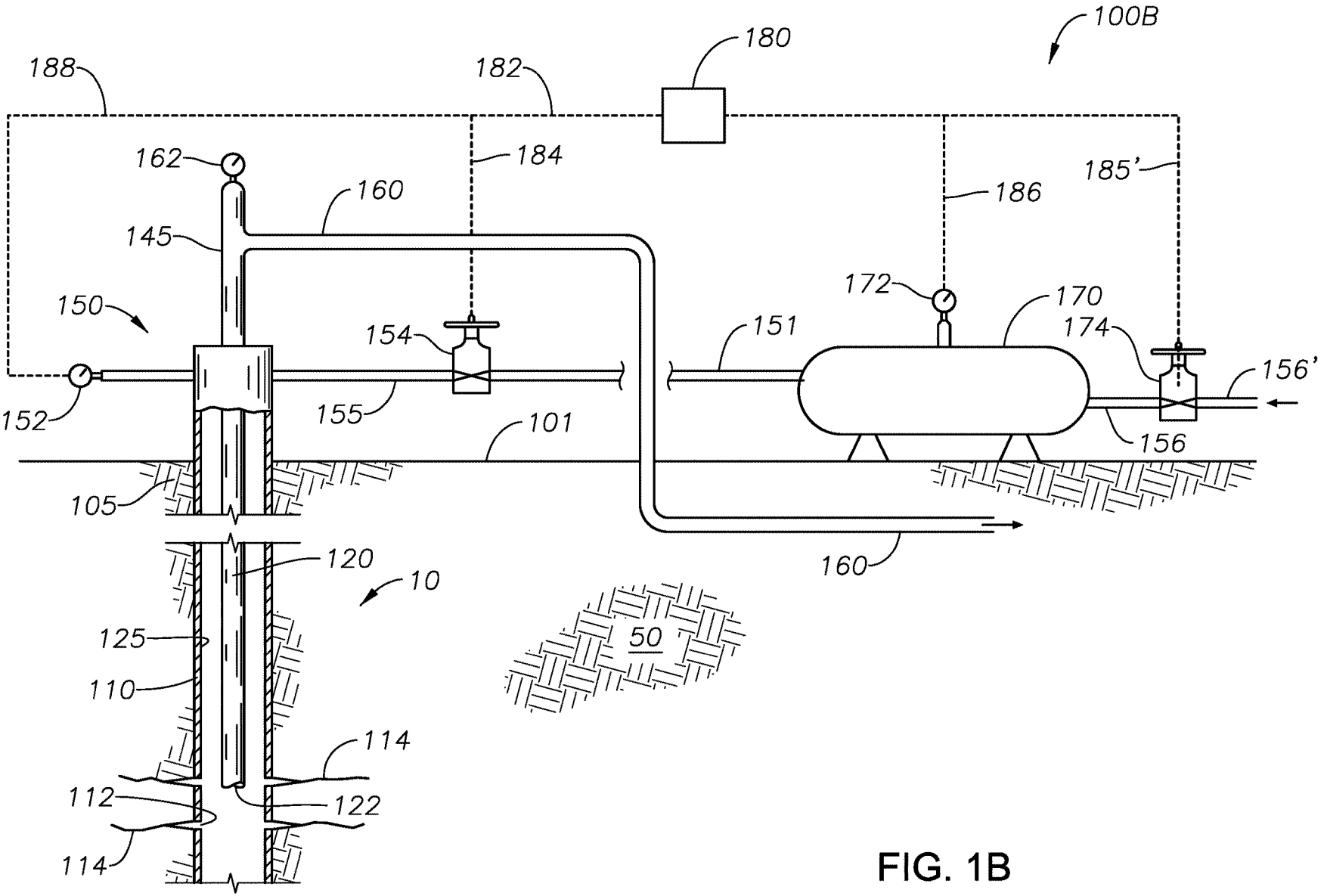
FIG. 1B is a schematic illustration of a gas injection optimization system for a wellbore, in a second embodiment. The gas injection optimization system again controls a volume of gas that is injected into the annular region of a wellbore to support gas lift. In this arrangement, gas injection is supplied by a remote (or facilities) gas compressor.
Figure 1C:
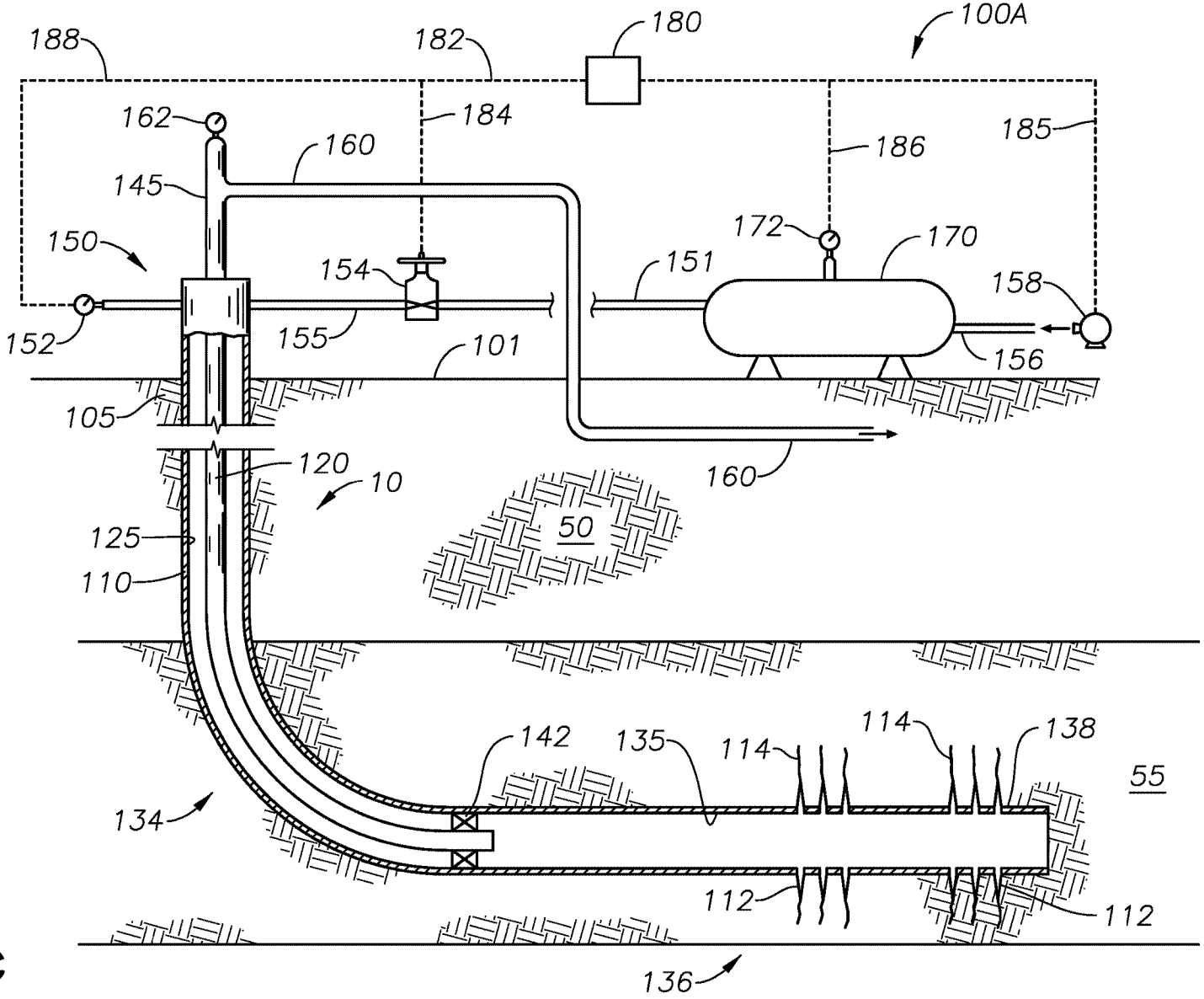
FIG. 1C is another schematic illustration of the gas injection optimization system of FIG. 1A. In this arrangement, the wellbore has been completed to have a horizontal section.

FIG. 1C is another schematic illustration of the gas injection optimization system 100A of FIG. 1A. In this arrangement, the wellbore 10 has been completed to have a horizontal section 136. The horizontal section 136 includes a heel 134 and a toe 138. The horizontal section 136 extends through a pay zone, shown at 55.

To access the pay zone 55, perforations 112 are shot through the casing 110 along the horizontal section 136. As part of the completion, the formation 50 along the pay zone 55 is fractured. Fractures are again shown at 114. Production fluids then flow from the formation 50 and into a bore 135 of the casing 110. Production fluids are prevented from flowing up the annular region 125 by use of a packer 142 at a lower end of the production tubing 120.

Figures 1, 1D:
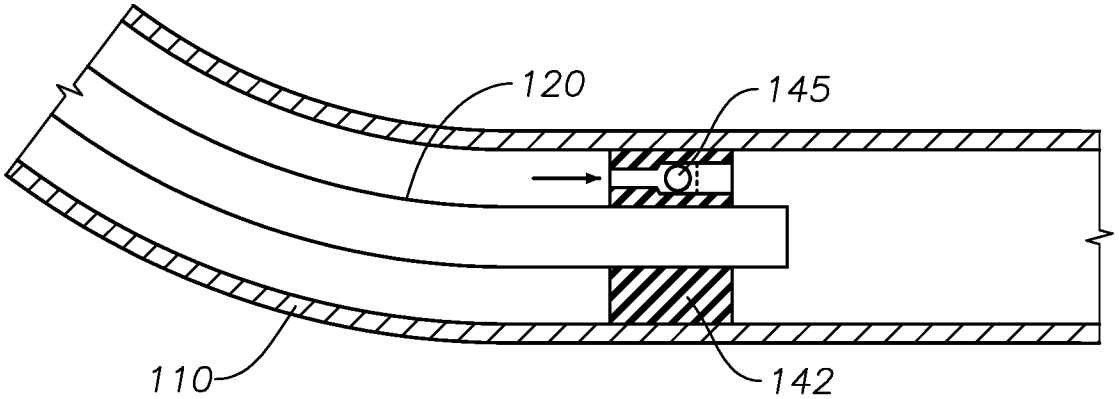
FIG. 1D-1 is an enlarged view of the packer of FIG. 1C. In this view, it can be seen that the packer includes a one-way check valve, permitting injection gas to flow past the packer in the wellbore.

FIG. 1D-1 is an enlarged view of the packer 142 of FIG. 1C. In this view, it can be seen that the packer 142 includes an optional one-way check valve 145. The check valve 145 permits injection gas to flow through the annular region 125 and down past the packer 145 in the wellbore 10.

Figures 1, 1D, 2:
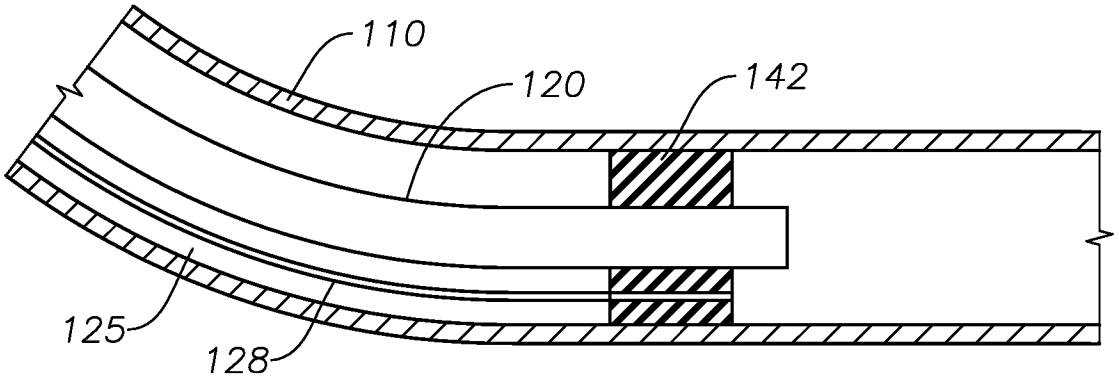
Figure 2:
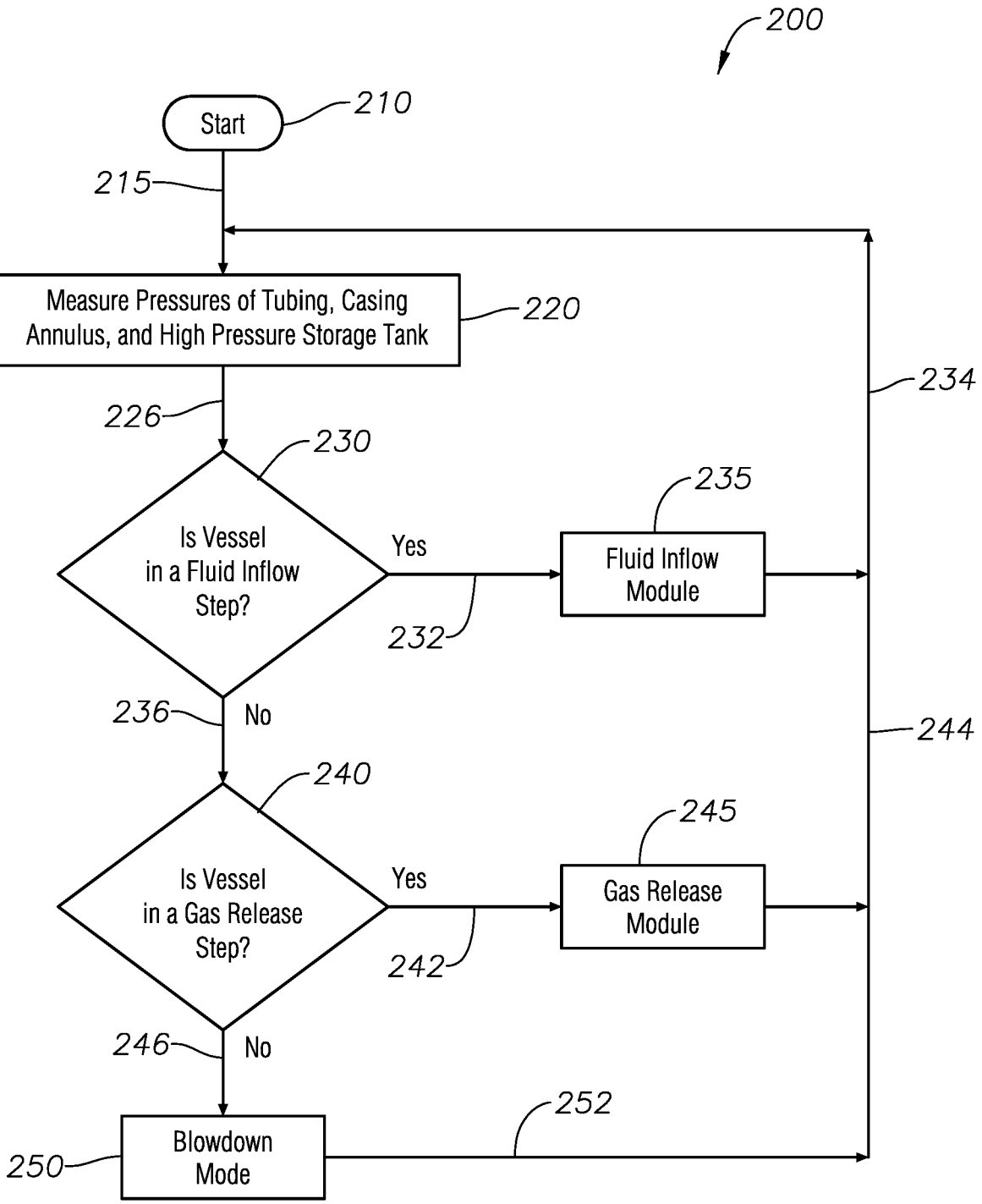

FIG. 1D-2 is another enlarged view of the packer 142 of FIG. 1C. In this view, a gas injection tubing 128 is provided in the annular region 125 of the wellbore 10. The gas injection tubing 128 is an alternative to injecting the gas directly into the open annular space 125.

To facilitate injection into the annular region 125, the gas injection optimization system 100A includes a gas compressor 158. In the arrangement of FIG. 1A, the compressor 158 is located at the wellbore 10. Preferably, the compressor 158 is a dedicated compressor for the well site, and reinjects light hydrocarbon fluids (that is, fluids in the gaseous phase at ambient conditions) that have been produced from tubing string 120 and separated at the surface 101. (A separator again is not shown, but is understood to be present by those of ordinary skill in the art.)

In the arrangement of FIG. 1A, the gas compressor 158 does not inject gas directly into the annular region 125 as is done in existing gas lift procedures; rather, the gas compressor 158 first injects gas into a high pressure storage vessel 170 that resides proximate the well head 150. The gas storage vessel 170 may be, for example, a 36" by 10', 1,440 psi-rated vessel capable of delivering 4 MSCF given a 700 psi pressure swing. The vessel 170 is preferably equipped with a 2" input line 156 at the bottom or at one end, and a pressure relief (or PSV) associated with a pressure gauge 172 on top. No internals for the vessel 170 are required. Of interest, if the gas is exhausted from the vessel 170 in a ten minute period. This is equivalent to an average rate of 576 MSCFPD rate.

In order to control the injection of gas from the gas storage vessel 170 and into the annular region 125, a well flow control valve 154 is provided. In the arrangement of FIG. 1A, the well flow control valve 154 is placed along the injection line 155. However, the well flow control valve 154 may alternatively be placed at the well head 150 or may be integral to an outlet line 151 of the vessel 170. The well flow control valve 154 may be, for example, a Kimray high pressure motor valve model 2200 SMT, or equivalent.

The well flow control valve 154 is controlled by a specially-configured controller 180. Preferably, the controller 180 is an embedded programmable logic controller (or "PLC"). The controller 180 may be, for example, the Triangle EZ Wire 1616, which offers an open board design, combined with Ladder+ BASIC programming software with an internal clock. Operations software is downloaded into the programmable logic controller 180.

The controller 180 preferably has eight analog inputs and 16 digital inputs (or pins) with a high speed counter. Additionally, the controller 180 preferably has four analog outputs and 16 digital outputs. The controller 180 performs advanced floating math, and includes a back-up battery.

The controller 180 may have other components. These may include a printed circuit board, an analog input/output card, and a bus port. The controller 180 may also include an expansion port. An Ethernet port may be provided that can connect to other devices or web servers for remote control or data up/down loading. Finally, the controller 180 may have an LCD interface and display for on-site control.

The controller 180 is configured to generate control signals. The signals are represented by lines 184 and 185. Control signals 184 are sent to the well flow control valve 154 to adjust a position of the control valve 154 and, thereby, control the flow of gas from the high pressure storage vessel 170 into the annulus 125. Optionally, control signals 185 are sent to the compressor 158 to control operating speed. In one aspect, the control signals 184, 185 are wireless signals that are sent from a remote transceiver for communicating operating state through a wireless communications network.

As part of the control function, the controller 180 receives pressure signals. First, signals are received from a pressure gauge 162, or transducer, associated with the production line 145. Pressure signals from the production line 145 are represented by dashed line 182. Of course, it is understood that the pressure gauge 162 may be placed along production line 160.

Also shown in FIG. 1A is a second pressure gauge 172, or transducer. The second pressure gauge 172 measures pressure in the high pressure storage vessel 170. Readings taken by the pressure gauge 172 may also be delivered to the controller 180, such as by means of a wireless signal or an electrical or fiber optic wire, represented by dashed line 186.

Also shown in FIG. 1A is a third pressure gauge 152, or transducer. The third pressure gauge 152 measures pressure in the annular region 125. Readings taken by the pressure gauge 152 may also be delivered to the controller 180, such as by means of a wireless signal or an electrical or fiber optic wire, represented by dashed line 188.

The controller 180 receives pressure signals 182, 186, 188 and stores them in memory. To this end, the controller 180 will include a memory module such as a ferromagnetic random access memory card. The controller 180 may also include an on-off selector switch (not shown). This switch may be, for example, the Automation Direct GCX Series Selector Switch, Model GCX1200. A contact block for the GCX switch will also be included. The selector switch is connected to shielded wires each containing, for example, two 18-gauge conductors.

When in the OFF position, the On-Off switch will keep the controller 180 from operating, and the gas injection optimization system 100 will behave as if there were no control. In this condition, the valve 154 is left in a full-open position, allowing for a continuous injection of compressible fluid by the compressor 158. Preferably, injection is in accordance with the CGC principle. This means that gas is injected at a rate sufficient to create flow through the production tubing 120 that exceeds a minimum rate (or "critical flow rate") for a period of time necessary for gas lift. In other words, fluids ($V_S$) in the production tubing 120 will be pushed up the hole and to the surface 101.

In the ON position, the controller 180 will control the volume at which the compressible fluid is injected into the annular region 125, in real time. The controller 180 is configured to receive pressure value signals from the first pressure transducer 162, the second pressure transducer 172 and the third pressure transducer 152. In response, the controller 180 will send control signals that cyclically open and close the well flow control valve 154. When the well flow control valve is closed, compressible fluid is directed through the inlet line to pressurize the gas storage vessel 170. When the well flow control valve 154 is opened, injection gas ($V_R$) exits the outlet line 151, flows through the gas injection line 155, and is injected into the annular region 125. Thus, an intermittent gas lift system is provided.

As a result of the operation of the controller 180, the injection system 100A cycles between a fluid in-flow stage (or vessel loading stage) wherein the gas storage vessel 170 is loaded with gas up to a set pressure range that correlates to a desired volume, and a fluid release stage (or gas injection stage) where the gas storage vessel 170 releases gas ($V_R$) into the gas injection line 155 and on to the annular region 125. In one aspect of the invention, the controller 180 infers a volume of liquid ($V_S$) residing in the tubing string 120 based on differential pressure ($\Delta P$) between the tubing string 120 (as measured by transducer 162) and the surrounding casing 110 (as measured by transducer 152). Based upon the known tubular geometries in the wellbore 10, the controller 180 then determines how much compressible fluid ($V_R$) should be loaded into the gas storage vessel 170 before release. The greater the ΔP, the greater the fluid volume (or height of a fluid slug) ($V_S$) exists in the tubing string 120. In turn, the greater the fluid volume ($V_S$), the greater the volume of gas ($V_R$) that should be accumulated into the gas storage vessel 170 for release. Thus, in one aspect of the invention, ($V_R$) is tuned to ($V_S$) in real time.

Real-time control of volumes of gas injected into the annular region 125 (either into the tubing-casing annulus 125 or through a dedicated line in the annulus 125) sufficient to lift the fluid slug ($V_S$) residing in the tubing 120 is maintained even as fluid composition and fluid volume in the tubing 120 change over the life of the well 10. Thus, the controller 180 controls the intermittent volume ($V_R$) stored in the storage vessel 170, which becomes the amount of gas released into the annular region 125. This is done in substantially real time based upon what the well 10 actually needs to lift reservoir fluids, and without need of a pilot valve.

FIG. 1B is a schematic illustration of a gas injection optimization system 100B for a wellbore 10, in a second embodiment. The gas injection optimization system 100B again controls a volume of gas that is injected into the annular region 125 of the wellbore 10 to support gas lift. System 100B is the same as system 100A, except that in this arrangement, gas is supplied by a central facilities compressor station (not shown). The compressor station provides pressure for multiple high-pressure gas lines that deliver injection gas to multiple wells, including the wellbore 10 of FIG. 1B.

In FIG. 1B, a gas input line 156' delivers gas to the high pressure storage vessel 170 to service the well site for wellbore 10. Gas is moved from the compressor station and through a motorized in-flow control valve 174. The in-flow control valve 174 may be, for example, an electrically actuated valve, such as an eccentric disk. Alternatively, and more preferably, the control valve 174 is a Kimray high pressure motor valve model 2200 SMT, or equivalent, with ⅞" trim. The control valve 174 is used to adjust the amount of gas that enters the storage vessel 170.

In order to adjust the vessel in-flow control valve 174, signals are sent from the controller 180 by means of control line 185'. The control line 185' may include copper wires that transmit a variable current to adjust a position of the vessel in-flow control valve 174, or may comprise a data cable that sends command signals to firmware or hardware in the vessel in-flow control valve 174. Alternatively, control line 185' may in the form of a wireless signal sent by a transmitter associated with the controller 180.

It is noted that other sources of gas for line 156' may be used. These may include gas supplied through a local storage tank, a remote storage tank or a remote separator via pipeline. In these instances, a small compressor (such as compressor 158 shown in FIG. 1B) would be used to provide at least modest pressure to feed into the vessel in-flow control valve 174 and the gas storage vessel 170.

As with the gas injection optimization system 100A, the system 100B utilizes a controller 180 to control an intermittent volume ($V_R$) stored in the storage vessel 170. This becomes the amount of gas released into the annular region 125.

FIG. 2 presents a flow chart 200 showing steps for controlling the injection of gas into a wellbore annulus, in one embodiment. Specifically, the volume is optimized for an intermittent wellbore gas-lift operation. The flow chart 200 is intended to be used in connection with the controller 180 of FIG. 1A or 1B.

FIG. 2 first shows a Start block 210. The Start block 210 assumes that a wellbore has been provided. The wellbore is configured to receive gas injection into an annular region in support of a gas lift operation. To this end, the wellbore will include a high pressure storage vessel supplied with a compressible fluid used for the gas injection. Additionally, the wellbore is configured with pressure gauges (or transducers) to separately measure pressures in the tubing string 120, the casing annulus 125 and the gas storage tank 170.

In the flow chart 200, line 215 is used to show a first step in the control process 200. Line 215 leads to Box 220, which shows that pressure readings are being taken by transducers associated with the tubing string 120, the casing annulus 125 and the gas storage tank 170. Those pressure readings are being sent in real time to the controller 180 as electrical, optic or wireless signals.

Pressure values are measured through the gauges, or pressure transducers 162, 152, 172. The controller 180 receives substantially continuous signals from the tubing pressure gauge 162, the casing pressure gauge 152 and the vessel pressure gauge 172. In either of systems 100A and 100B, the controller 180 operates to receive the pressure readings from the pressure gauges (or transducers) 162, 152 and 172. This is done through signals 182, 188, 186, respectively.

In operation, the operator will initially take a pressure differential measurement while the well is shut in, while the well has little or no liquid in the tubing string 120. The (ΔP) will be the difference between pressure in the casing (or annular region 125) and pressure in the tubing 120, as follows:

$$\Delta P = P_C - P_T$$

This difference may be, for example, 90 psi, and serves as a set point for pressure in the gas storage vessel 170. Of course, the operator may adjust this baseline based on experience and other field trials. Also note that where a packer is used, the casing 110 will not have liquids residing therein, nor will it experience a pressure gradient caused by fluid friction.

When the well is open for production, liquid will enter the tubing string 120. This increases the hydrostatic gradient in the tubing string 120, increasing the (ΔP). The value of (ΔP) will inform the controller 180 as to how much gas to release from the storage vessel 170 and into the annular region 125 to lift the liquid column in the tubing string 120. In this respect, the controller 180 will seek to maintain a (ΔP) of at least the set point, or an amount of [(ΔP)+x], where x is an adjustment value based on experience or field trials as mentioned above.

During operation, the gas injection optimization system 100A, 100B cycles between a fluid in-flow (or vessel loading) stage where compressible fluid is being loaded into the gas storage vessel 170 at the surface, and a fluid release (or gas injection) stage where injection gas is being released from the storage vessel 170, through the well flow control valve 154 and into the annular region 125. To effectuate the gas injection optimization system, the controller 180 makes two separate inquiries. These are referred to as a Fluid-In-Flow Query (shown at Query 230) and a Fluid Removal Query (shown at Query 240).

In the illustrative flow chart of FIG. 2, upon receiving the pressure readings in Block 220, pressure values are stored in memory of the controller 180 as a function of time. The controller 180 then moves to the Fluid-In-Flow Query 230. This is indicated at line 226. In the Fluid-In-Flow Query 230, the controller 180 asks whether the control process 200 is in its fluid in-flow (or pressure build-up) process. If the answer is "Yes," then the system moves to a Fluid In-Flow Module 235 as demonstrated by line 232.

If the answer is "No," then the system asks whether the process 200 is in its working gas release (or fluid removal) process. This is shown in the Fluid Removal Query 240 according to line 236. If the answer is "Yes," then the system moves to a Gas Release Module 245 as demonstrated by line 242.

In either instance, once the routine associated with the Fluid In-Flow Module 235 or the routine associated with the Gas Release Module 245 is complete, the process returns to the Start block 210 (or at least line 215).

Figure 3A:
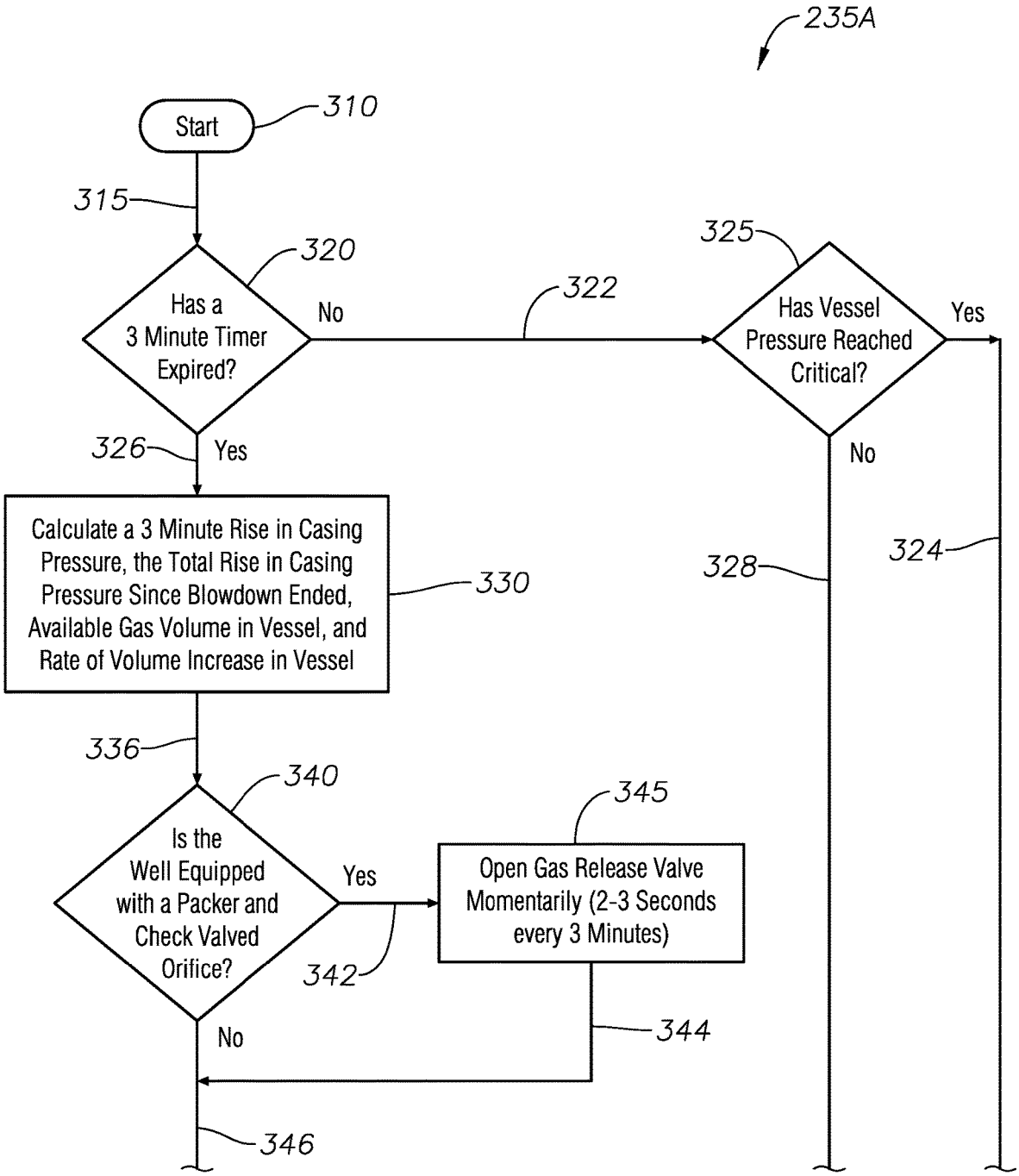
FIGS. 3A and 3B present a single flow chart for steps used in a Fluid In-Flow Module of FIG. 2, in one embodiment. In this Module, compressible fluid is injected into (and pressure is increased within) a gas storage vessel at the surface.
Figure 3B:
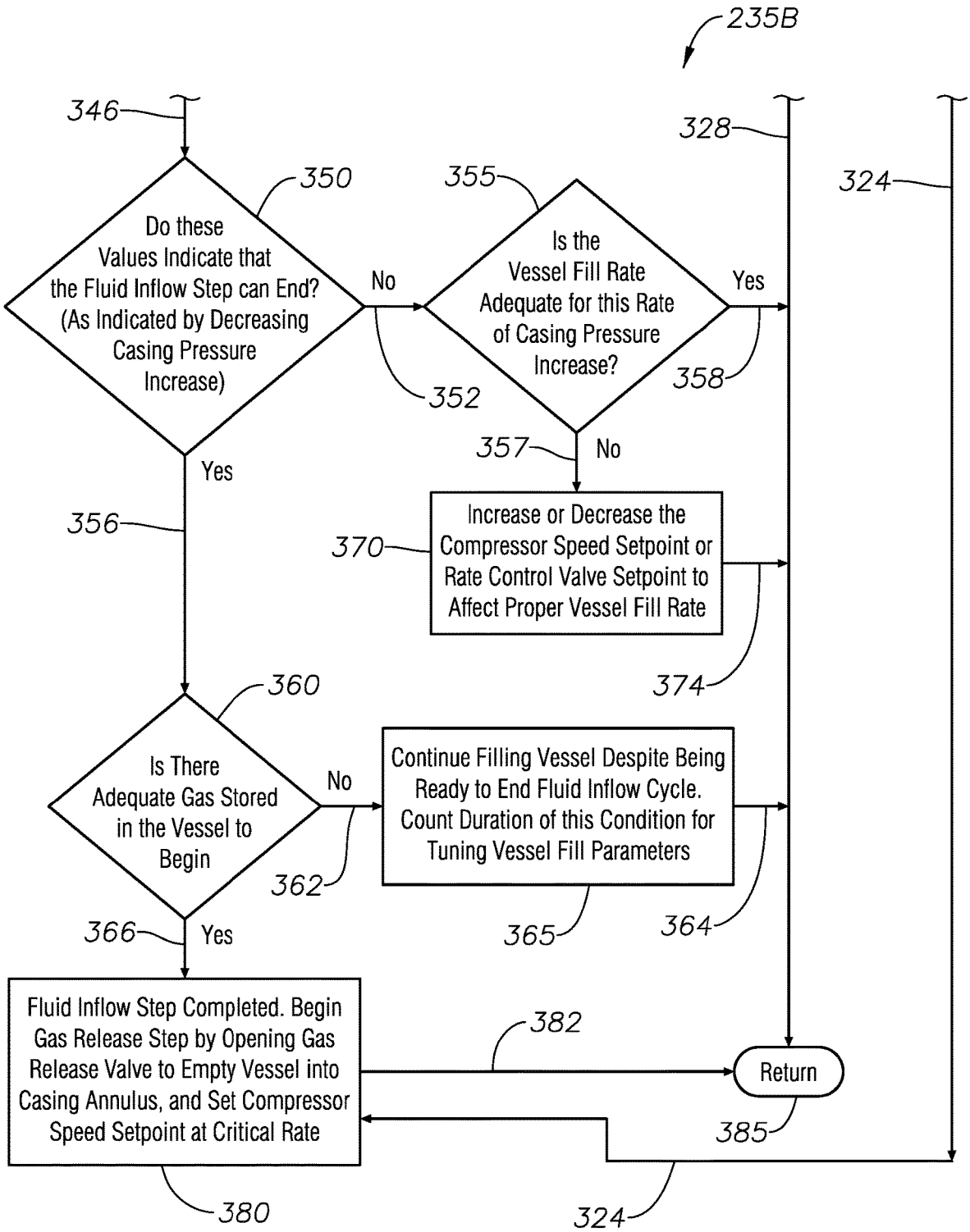

FIGS. 3A and 3B present a flow chart for steps used in the Fluid In-Flow Module 235. The Fluid In-Flow Module 235 is separated into flow charts 235A and 235B for illustrative purposes. However, it is understood that flow charts 235A and 235B are a single flow chart and will be described together as such.

The Fluid In-Flow Module 235 begins with Start block 310. This indicates that the surface storage vessel 170 is in its pressure build-up process. The Module 235 then moves to Query 320, as shown in line 315. In Query 320, a timer is queried to see if a pre-set time has expired during the pressure build-up process. In the illustrative flow chart 235A, the timer is set to three minutes. If the pre-set time interval has not expired, then the Module 235 moves to a new query according to line 322. The query, shown at Query 325, asks whether the high pressure storage vessel 170 has reached a pre-set critical pressure. This "critical" pressure is related to the maximum safe operating pressure of the high pressure storage vessel 170. If it has not, then the process moves according to line 328, and returns to the time inquiry of Query 320 (shown at Return block 385). In this situation, gas will continue to enter into the storage vessel 170 in response to compressor operation.

If the high pressure storage vessel 170 has reached its pre-set critical pressure, then the Module 235 moves according to line 324 to Box 380. Box 380 provides that the Fluid In-Flow Module routine 235 is complete. The well flow control valve 154 is opened and the volume of gas ($V_R$) in the gas storage vessel ("HPSV") 170 is released into the casing annulus 125. Thereafter, the controller 180 moves to the Return block 385, and the control process 200 moves back to line 215 of FIG. 2.

It is understood that during the entire Fluid In-Flow Module 235, up until Box 380, the well flow control valve 154 remains closed. This prevents gas from leaving the HPSV 170 until the vessel 170 holds the desired volume ($V_R$) of working gas or until the critical pressure is reached. When the Fluid In-Flow Module 235 is completed, then the well flow control valve 154 is opened and gas can be released from the gas storage vessel 170.

Returning to Query 320, if the three-minute timer has expired, then the module 325 moves according to line 326 to Box 330. In Box 330, the controller 180 goes through a series of calculations. These include:

- calculating the rise ($\Delta P_{C1}$) in casing pressure over the course of the three minutes (or other pre-set time);
- calculating the rise ($\Delta P_{C2}$) in casing pressure since a previous Blowdown ended (to be discussed below);
- calculating the available gas volume in the pressure vessel; and
- calculating the rate of volume increase (dV/dy) during the preceding three minute (or other pre-set time) interval.

After the calculations of Box 330, the controller 180 moves to a new query, shown at Query 340. This is indicated by line 336. In Query 340, the controller 180 asks if the well is equipped with a packer and a check valve orifice. If the answer is "Yes," then the process moves to Box 345 according to line 342. In Box 345, a signal is sent via line 184 to open the well flow control valve 154, at least momentarily. For example, the flow control valve 154 may open for 2 to 3 seconds. A small amount of gas may then be directed into the casing annulus 125 for the purpose of ascertaining the quantity of fluid accumulating inside the tubing 120. In this respect, injecting gas allows the controller 180 to obtain updated ΔP values.

The rate of gas injection in Box 345 would be very small, for example, only 32 MSCFPD. This gas would build the pressure inside the annular region 125 to offset the liquid accumulation and frictional losses up the tubing 120 of whatever is flowing into the tubing string 120. If excess gas is injected and enters the tubing string 120, it would not be significant enough to lift any wellbore fluids. In fact, a small amount of excess gas injection is desired to enhance the accuracy of a determination of the fluid slug height ($V_S$).

If the well is not equipped with a packer and a check valve orifice, then the control process 200 simply moves on to Query 350. This is seen at line 346. Query 350 asks if the values calculated in Box 330 indicate that a rate of increase in casing pressure $d(\Delta P_{C1})/dy$ has begun to decrease. This indicates that fluid in-flow can end. If the rate of change is not decreasing, then the process asks if the high pressure storage vessel fill rate is adequate for the rate of casing pressure increase. This is provided at Query 355, as indicated at line 352. If the answer is "Yes," then the process moves according to line 358 and then 328 to the Return block 385.

On the other hand, if the answer is "No," then either the compressor speed is adjusted (system 100A) or the control valve is adjusted (system 100B) in order to provide a proper fill rate for the storage vessel 170. This is shown at Box 370 following line 357. In this way, the degree of adjustment of the compressor speed 158 (FIG. 1A) or of the vessel input control valve 174 (FIG. 1B) may be correlated to the rate of casing pressure increase. This is implied in Query 355 and is also mentioned in connection with Box 550 described below.

It is desirable to adjust the compressor speed (system 100A) or the gas in-flow valve opening (system 100B) to adjust the fill rate for the HPSV 170. Otherwise, the vessel 170 will always have too much or too little gas when the desired (ΔP) value is reached. If a gas fillage rate is too high, the vessel 170 will fill while reservoir fluids are still coming into the tubing string 120. The operator would have to implement a cycle prematurely, stop filling the vessel 170 (perhaps by bypassing the working gas to a reserve tank) or run the risk of over-filling the vessel 170.

If the fillage rate is too low, reservoir fluids are no longer coming into the tubing string 120, and a needed gas release cycle is delayed. The cycle is interrupted to wait for the vessel 170 to reach ($V_R$).

Upon making the adjustment of Box 370, the control process 200 moves to the Return block 385. This is according to line 374 and then 328. The Fluid In-Flow Module 235 routine then starts over at Start block 210.

Going back to Query 350, if the values calculated in Box 330 indicate that a rate of increase in casing pressure $d(\Delta P_{C1})/dy$ has substantially decreased, then a next query is introduced. This is provided via line 356. For example, say the first 3-minute interval had a 20 psi pressure increase in the casing, the second 3-minute interval had a 15 psi increase, the third 3-minute interval had a 10 psi increase, a fourth 3-minute interval had a 5 psi increase, a fifth 3-minute interval had a 3 psi increase, and a sixth 3-minute interval had a 1 psi increase. Total pressure increase was 20+15+10+5+3+1=54 psi, and this 54 psi will correlate directly to ($V_S$). However, the ΔP went from 20 psi in 3 minutes to 1 psi in 3 minutes, indicating no more fluid is entering the production tubing 120. This is all taking place while the flow control valve 154 is closed and working gas is moving into the HPSV 170. This is one way of determining when it is time to open the valve 154 and begin the Gas Release Module 245.

It is noted that the 54 psi term can be used to separately figure out how much gas needs to be in the storage vessel ($V_R$) before the next Gas Release Module 245 begins. The 54 psi term is indicative of a ratio of the storage vessel ΔP to the casing ΔP that the controller 180 auto-tunes in connection with Box 370 discussed above).

The next query is Query 360, which asks if there is adequate gas stored in the high pressure storage vessel 170 to meet gas lift needs. To ascertain this, the controller 180 determines whether the pressure reading of transducer 172 indicates that ($V_R$) is adequate to meet the fluid slug ($V_S$) suggested by the pressure differential measurement ΔP. If the answer is "No," then the controller 180 will direct gas to continue filling the vessel 170. This is shown through line 362 leading to Box 365.

In Box 365, the compressor (either dedicated wellsite compressor of system 100A or the central compressor of system 100B) will continue to fill the vessel 170 until adequate gas has been stored in gas storage vessel 170 to meet gas lift needs. Optionally, this additional fill time and pressure may be used to adjust pre-set parameters in the controller 180 for future pressure build-up cycles. Such pre-set parameters may be, for example, the baseline ΔP value, the x adjustment value, the pre-set time interval value, the $V_R$ value, and so forth. Thereafter, the Module 235 moves to the Return block 385 by means of lines 364/328 and then to Start block 210 (or line 215).

On the other hand, if the answer is "Yes," then the Fluid In-Flow Module 235 is considered complete. As noted above, the well flow control valve 154 is opened and the volume of gas ($V_R$) in the gas storage vessel ("HPSV") 170 is released into the casing annulus 125. This is provided at line 366 and Box 380.

Referring again to Fluid Removal Query 240, the controller 180 asks if the control process 200 is in its fluid removal (or gas release) step. If the flow control valve 154 has been opened in Box 380 of FIG. 3B, then the answer is "Yes" and the system moves to the Gas Release Module 245. This is demonstrated by line 242.

The controller 180 begins the Gas Release Module 245 where gas is released from the HPSV 170. This is indicated at line 242 of FIG. 2.

Figure 4:
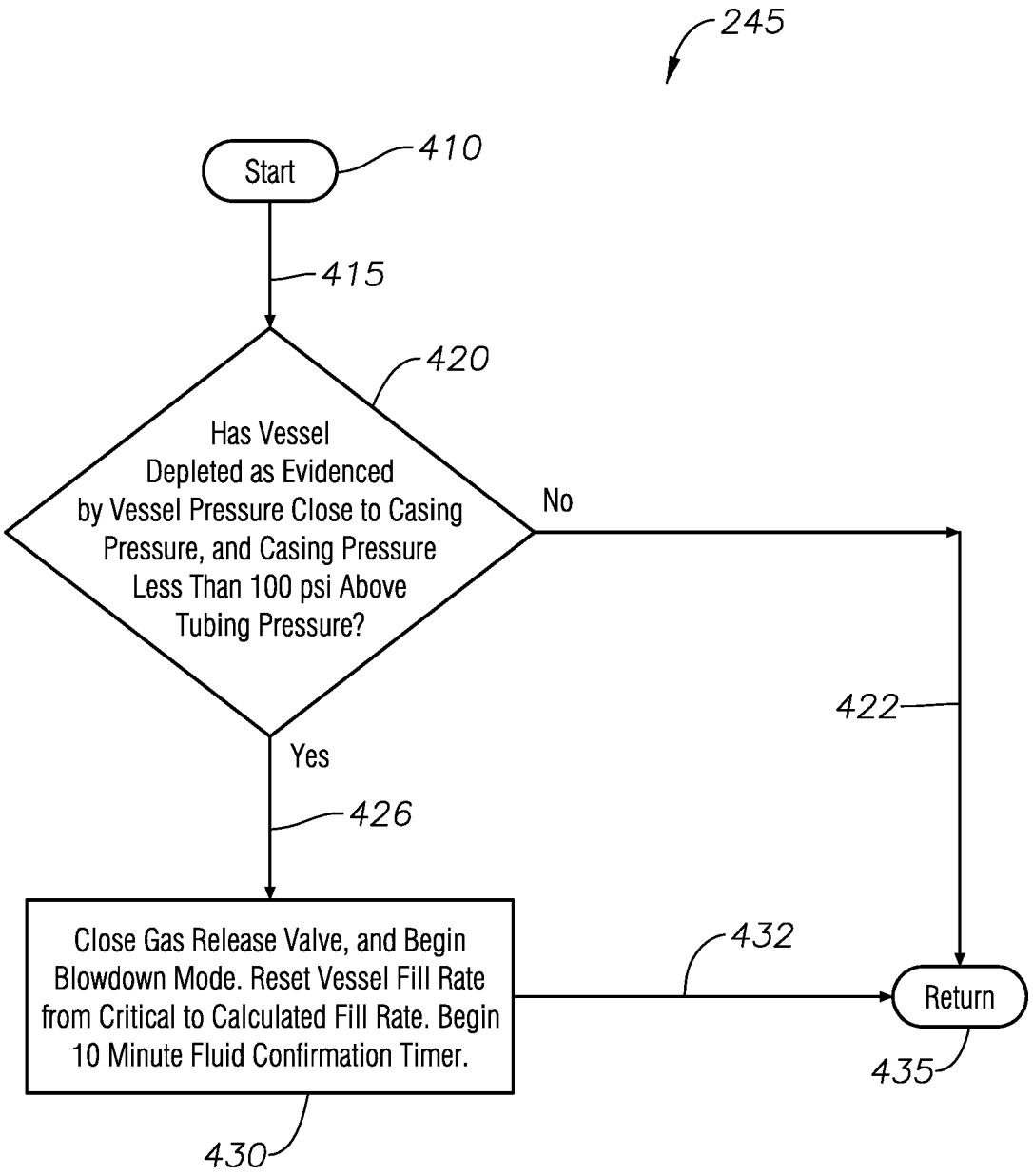
FIG. 4 is a flow chart presenting steps associated with a Fluid Removal Module, in one embodiment. In this Module, compressible fluid is released from (and pressure is decreased within) the gas storage vessel at the surface.

FIG. 4 is a flow chart presenting steps associated with the Gas Release Module 245. In this Module 245, gas is being released from the high pressure storage vessel 170 and into the annular region 125 for gas lift. The Gas Release Module 245 begins with Start block 410. The Module 245 then moves to Query 420, as shown in line 415. In Query 420, the Module 245 asks if the high pressure storage vessel 170 has been depleted. This is indicated, for example, if the pressure in the vessel 170 (as reported by gauge 172) has been reduced down to the casing pressure (as reported by gauge 152), and if the casing pressure (from gauge 152) is less than 100 psi above the tubing pressure (as reported by gauge 162). This would be an indication that ($V_R$) has been released into the annular region 125 and has done its job of displacing the fluid $V_S$ in the tubing string 120.

If the answer is "No," then the Module 245 returns to line 215. This is shown by line 422, which directs to Return block 435. The Gas Release Module 245 continues.

If the answer is "Yes," then the Module 245 sends a signal 184 to the flow control valve 154 to close according to line 426. The controller 180 then moves to a Blowdown Module, shown at Box 430. This is also seen at Box 250 in FIG. 2 and is described in greater detail in FIG. 5 in connection with Module 250. Thus, the system moves from Fluid Removal Query 240 to Box 250 via line 246.

Figure 5:
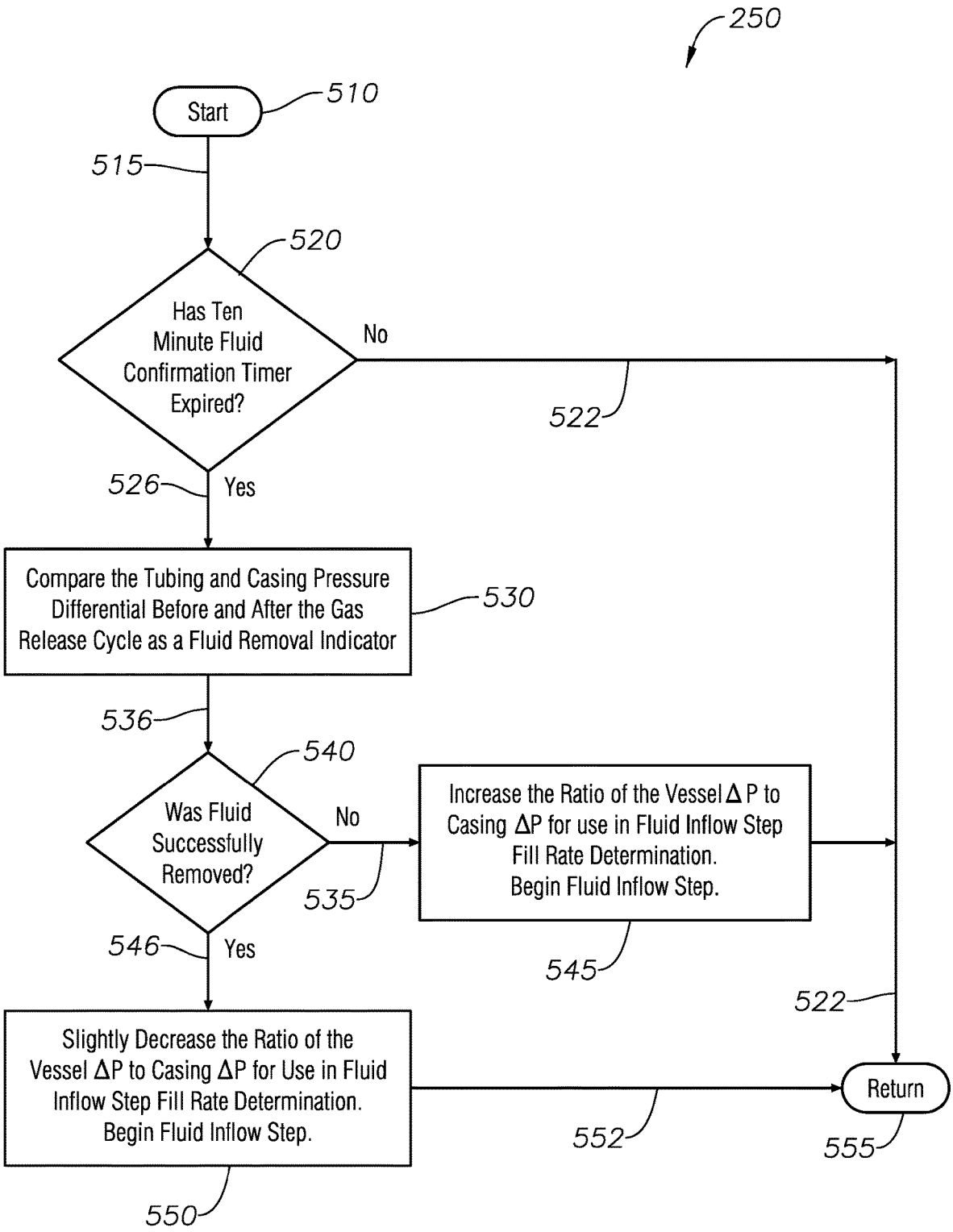
FIG. 5 is a flow chart presenting steps for a Blowdown module, in one embodiment. In the Blowdown Module, pressure is iteratively monitored as between the high pressure gas storage vessel and the casing (or tubing-casing annulus).

Before moving to FIG. 5, and to further explain the control process 200, it is helpful to understand that the controller 180 is looking at the rate of pressure drop in HPSV 170. Upon initially opening the flow control valve 154, gas pressure in the HPSV 170 will decline rapidly, and then level off. Once ΔP has dropped, say, from 10 units to 1 unit, the controller 180 knows that the vessel 170 is substantially depleted of gas ($V_R$). The controller 180 can now close the valve 154 and discontinue injection as shown in Box 430 of FIG. 4.

It is noted that in connection with Box 430, a fill rate for the storage vessel 170 may be reset. This is an opportunity for the controller 180 to change gas injection rate (or "fill rate") and gas fill volume ($V_R$) to compensate for the results of the calculations of Boxes 365 or 370/550. In addition, a ten minute fluid confirmation timer may be set. This means that time is allowed for the tubing string 120 to "blow down."

Referring again to FIG. 2, a Blowdown Module is also provided. This is seen at Box 250. The purpose of the Blowdown Module and the ten minute timer is to give the injected gas ($V_R$) (along with production fluids) a chance to exit the production tubing 120. Only when this happens can the Fluid Inflow Module 235 be initiated, as the measured pressure values in Box 220 will otherwise be skewed.

FIG. 5 is a flow chart presenting steps for the Blowdown Module 250. In the Blowdown Module 250, the storage vessel 170 is prepared to return to the Fluid In-Flow module 235. The Blowdown Module 250 begins with Start block 510. This indicates that the control process 200 is no longer in the Gas Release Module 245. The Module 250 first moves to Query 520, as shown in line 515. In Query 520, the Module 250 asks if the ten minute fluid confirmation timer as initiated in Box 430 has expired. If the answer is "No," then the controller 180 stays in the Blowdown Module 250. This is shown at line 522 of FIG. 5, where the Module 250 moves to a Return block 555.

If the answer to Query 520 is "Yes," then the Blowdown Module 250 moves to Box 530. This is done via line 526. Box 530 introduces a comparison process. The tubing pressure (as measured by gauge 162) is compared to the casing pressure (as reported by gauge 152). These pressure differentials themselves are then compared before and after the Gas Release Module 245. This is an indication of fluid removal from the vessel 170. If the tubing and casing pressures are now similar, then ΔP is essentially "0" and all liquids have been successfully removed and the control process 200 moves to Box 550. On the other hand, if the ΔP level is not significantly changed, then fluid ($V_S$) was not successfully removed.

The Blowdown Module 250 next moves to Query 540. This is shown through line 536. Query 540 asks if the fluid removal was successful, meaning that well fluids have left the production tubing 120, and entered the production line 160 during operation of the Gas Release Module 245. If the answer is "No," then the module 250 moves to Box 545 via line 535. In Box 545, the controller 180 slightly increase the ratio of the storage vessel ΔP to the casing ΔP for use in the Fluid In-Flow Module 235 to determine fill rate (per Box 370).

It is understood that the opening pressure for the surface vessel 170 are determined based on measured differences in the tubing and casing pressure, meaning measurements taken by transducers 162 and 152, respectively. The difference between the tubing and casing pressure readings equals the sum of frictional flow losses up the tubing string 120 and the liquid content in the tubing string 120. Once a fluid slug has been lifted to the surface 101, the control valve 154 will close off the HPSV 170, initializing the (ten minute) after-flow period. Once this after-flow period has blown down the tubing and casing pressures, the pressure inside of the casing (that is, annular region 125) and inside of the tubing string 120 should be very close to the same pressure, as there is only a gas gradient in each flow conduit. At this point, new reservoir fluids should be entering the tubing 120, since bottom hole pressure is relatively low. The Blowdown Module 250 is then complete, and the control process 200 returns to line 215 via Return block 555.

If the answer to the question of Query 540 is "Yes," meaning that ($V_S$) was successfully removed from the tubing 120, then the controller 180 will make a slight decrease in the ratio of the storage vessel ΔP to the casing ΔP. For example, the decrease may be 0.5. This is used in connection with the fill rate determination provided for in Box 370 of FIG. 3B. The Module 250 is then complete, and returns to line 215 via Return block 555. This is shown at line 552.

As can be seen, an improved injection system for a gas lift operation is provided. In accordance with the invention, the gas lift valves and/or downhole pilot valve commonly used in wells is replaced with a high pressure gas storage vessel at the surface. In this way, a downhole valve placed along the tubing is no longer needed. More importantly, the operator need not periodically replace gas lift valves, or pull the pilot valve and tune its pressure set points to accommodate changing downhole conditions.

In the present invention, a gas-lift flow control valve 154 is used to control the injection of pressurized compressible fluid at optimized volumes. In the injection system of the present invention, gas is first injected into a high pressure storage vessel 170 at the surface 101 before being injected into the production-casing annulus 125. Injection into the storage vessel 170 is controlled by a small PLC, or controller 180.

In one embodiment, the controller 180 controls compressor speed. In this embodiment, a well site compressor 158 is provided. The compressor 158 receives speed control signals 185 from the PLC (or controller) 180 to keep the compressor 158 output flow rate within a desired range. The system (shown at 100A in FIG. 1A) cycles between an in-flow stage where the vessel 170 is being filled, and a release stage where gas is being released from the vessel 170 and into the casing annulus.

In a second embodiment, the PLC (or controller) 180 controls a choke (or in-flow control valve) 174. This is used when gas is being supplied by a remote compressor station or remote gas source. The in-flow control valve 174 receives control signals 185' from the controller 180 to keep it open such that gas flows into the vessel 170 within desired flow rates. The system (shown at 100B in FIG. 1B) cycles between an in-flow stage where the vessel 170 is being filled, and a release stage where gas is being released from the vessel 170 and into the casing annulus.

The cycling times are controlled by the controller 180 in response to pressures in the surface vessel 170 reaching set points chosen by the controller 180. Variables for establishing set points include:

1) the rate of fill for the surface pressure vessel, which is proportional to the number of intermittent cycles (fast fill=more cycles), and
2) the opening and closing pressures in the surface pressure vessel.

Beneficially, the intermittent gas-lift operation can be tuned to optimize production for the minimum amount of injection gas. This benefit cannot be achieved with conventional downhole pilot valves. Thus, the amount of injected gas with each cycle is adjusted.

The method may optionally include adjusting a rate of gas injection into the annular region to ensure that critical flow velocity is achieved in the production tubing. It is understood that gas volumes moving through the production tubing may be calculated based on pressure differentials and known tubing-casing geometries. Thus, critical flow may be met by taking pressure readings, recording the pressure readings, calculating pressure differentials, correlating pressure differentials with fluid flow velocity, and adjusting the pressure differentials.

In one aspect, the controller monitors flow velocity. When flow velocity falls below the critical velocity, the controller ends the Gas Release Module. This is as opposed to simply waiting for the gas storage vessel to deplete. More preferably though, the controller simply waits for the pressure in the gas storage vessel to level off (meaning that the decline rate has flattened) as described above.

If an on-site compressor is used, then the step will include adjusting the compressor speed during a fluid in-flow stage. This may include increasing the compressor speed when a calculated ΔP between the production tubing and the annular region is greater than a previous ΔP. Reciprocally, compressor speed may be decreased in response to ΔP measurements.

If a remote compressor is used, then a control valve is provided at the pressure vessel to control an amount of gas, or a rate of gas, entering the pressure vessel during a fluid in-flow stage. This may include increasing the control valve opening when a calculated ΔP between the production tubing and the annular region is greater than a previous ΔP. Reciprocally, the control valve may be choked in response to ΔP measurements.

In rare instances, the operator may wish to keep an existing pilot valve, or plunger, downhole along the production string to make the injection process more efficient. Plunger lift equipment is recognized for its ability to improve gas-lift efficiency by organizing the flow. However, this is neither necessary nor preferred.

As can be seen, improved gas injection optimization systems are offered. Using the systems, a method of optimizing gas injection volume for a gas-lift system may be provided.

The method first includes providing a wellbore. The wellbore has been formed for the purpose of producing hydrocarbon fluids to the surface in commercially viable quantities. Preferably, the well primarily produces hydrocarbon fluids that are compressible at surface conditions, e.g., methane, ethane, propane and/or butane. In one aspect, the wellbore has been completed horizontally. In this instance, the gas optimization system may be offered to help overcome a problem of slug flow along the horizontal leg of the wellbore.

The method next includes associating a gas compressor with the wellbore. The gas compressor may be a well site compressor such as compressor 158; alternatively, the gas compressor may be a remote compressor that supplies gas to a plurality of wells in a field through service lines, such as line 156'. In either instance, the gas compressor is associated with the wellbore through a gas injection line such as line 155.

The method additionally includes providing a gas storage vessel at the surface. The gas storage vessel comprises an inlet for receiving a compressible fluid from the associated compressor, and an outlet for releasing the compressible fluid as an injection gas. The gas storage vessel operates as a substitute for the pilot valve placed at the lower end of the production tubing in a known intermittent gas lift system.

The method also includes producing hydrocarbon fluids through a production tubing, and up to a production line at the surface. An annular region is formed between the production tubing and a surrounding casing string. The annular region may be open, or may represent a dedicated flow tube in the annulus.

The method further includes providing a first pressure transducer. The first pressure transducer is associated with the gas storage vessel, meaning that pressure readings for the gas storage vessel are taken. The method then includes receiving signals ($S_1$) from the first pressure transducer in real time, and associating the signals ($S_1$) with gas volume within the gas storage vessel.

The method then provides intermittently releasing a volume of injection gas ($V_R$) from the gas storage vessel and into the annular region. The volume ($V_R$) is tuned to lighten a volume of liquid ($V_S$), that is, reduce the density of the liquid ($V_S$), that has accumulated within the tubing string during the production.

In one aspect, the method includes providing a second pressure transducer and a third pressure transducer. The second pressure transducer is configured to determine pressure in the production tubing, while the third pressure transducer is configured to determine pressure in the annular region.

The method additionally includes providing a well flow control valve. The well flow control valve is positioned between the outlet for the gas storage vessel and the annular region. Preferably, the well flow control valve is placed along the gas injection line at the surface.

The method then includes providing a controller. The controller is configured to receive pressure value signals from the first pressure transducer, the second pressure transducer and the third pressure transducer, and in response, send control signals that cyclically open and close the well flow control valve. When the well flow control valve is closed, compressible fluid is directed through the inlet to pressurize the gas storage vessel; when the well flow control valve is opened, injection gas is injected into the annular region as volume ($V_R$). In one aspect, ($V_R$) is injected at or above a critical flow velocity for gas production in the production tubing for a period of time. This is the flow velocity for gas needed to carry entrained liquid particles to the surface.

The method also includes adjusting a rate of gas injection into the annular region (or Pillage rate) to ensure that critical flow velocity is achieved in the production tubing. If a well site compressor is used, then the step will include adjusting the compressor speed during a fluid in-flow stage. This may include increasing the compressor speed when a calculated ΔP between the production tubing and the annular region is greater than a previous ΔP. Reciprocally, compressor speed may be decreased in response to ΔP measurements to prevent having more gas injected than is actually needed to accomplish gas lift above the critical flow velocity.

If a remote compressor is used, then a control valve is provided at the pressure vessel to control an amount of gas, or a rate of gas, entering the pressure vessel during a fluid in-flow stage. This may include increasing the control valve opening when a calculated ΔP between the production tubing and the annular region is greater than a desired ΔP. Reciprocally, the control valve may be choked in response to ΔP measurements to prevent having more gas injected than is actually needed to accomplish gas lift above the critical flow velocity.

The gas injection optimization system is ideal for wells having a high GOR, such as 3,000 or greater, but also functions for wells with low GOR, such as 500. The system is also ideal for wells that are completed horizontally. Those of ordinary skill in the art will recognize that horizontal wells have a tendency to experience slugging. As gas invades the wellbore, the gas will build up along an upper surface of the casing along the horizontal leg. As pressure within the horizontal leg increases due to the build-up of gas, the gas will be released together as a "slug." This creates a period at which critical flow velocity is reached and no gas injection is needed. This slugging phenomenon repeats itself cyclically, presenting repeated instances where no gas injection (or substantially reduced gas injection) is needed.

Further variations of the method for optimizing gas injection rate may fall within the spirit of the claims, below. It will be appreciated that the inventions are susceptible to modification, variation and change without departing from the spirit thereof.

I claim:

1. An intermittent gas injection optimization system for a wellbore, comprising:

a tubing string placed in a wellbore, the tubing string extending from a surface down to a selected subsurface formation;

an annular region residing around the tubing string and within a surrounding casing string, the annular region also extending down into the wellbore and to the subsurface formation;

a gas storage vessel residing at the surface, the gas storage vessel comprising an inlet for receiving a compressible fluid from a compressor, and an outlet for releasing the compressible fluid as an injection gas;

a gas injection line configured to inject the injection gas from the gas storage vessel and into the annular region;

a well flow control valve positioned between the outlet for the gas storage vessel and the wellbore, and in fluid communication with the gas injection line;

a first pressure transducer configured to determine pressure in the tubing string;

a second pressure transducer configured to determine pressure in the annular region;

a third pressure transducer configured to determine pressure in the gas storage vessel;

a controller configured to receive pressure value signals from the first pressure transducer, the second pressure transducer and the third pressure transducer, and in response, send control signals that cyclically open and close the well flow control valve wherein, (i) when the well flow control valve is closed, compressible fluid is directed through the inlet to pressurize the gas storage vessel but cannot pass into the annular region, and (ii) when the well flow control valve is opened, a volume of injection gas ($V_R$) is injected through the well flow control valve and into the annular region to lift a volume of fluids ($V_S$) residing in the tubing string to the surface.

2. The intermittent gas injection optimization system of claim 1, wherein the controller is further configured to:

correlate pressure readings taken by the third transducer to the volume of compressible fluid present within the gas storage vessel, in real time; and tune ($V_R$) according to ($V_S$) during production such that ($V_R$) is adequate to remove ($V_S$).

3. The intermittent gas injection optimization system of claim 2, wherein the controller is further configured to:

calculate a pressure differential between (i) pressure readings taken by the first transducer and (ii) pressure readings taken by the second transducer, as ΔP, in real time; and correlate ΔP values to the volume of fluid ($V_S$) present within the tubing string during production.

4. The intermittent gas injection optimization system of claim 3, wherein the controller is further configured to control an amount of compressible fluid pumped through the inlet and into the gas storage vessel when the well flow control valve is closed to a volume of approximately ($V_R$).

5. The intermittent gas injection optimization system of claim 4, wherein the annular region is (i) an entire volume defined between the tubing string and the surrounding string of casing, or (ii) an injection line residing within the wellbore and along the tubing string.

6. The intermittent gas injection optimization system of claim 4, further comprising:

a packer residing at a lower end of the tubing string and configured to provide a seal of the annular region, wherein the packer comprises a check valve providing a through-opening through which injected gas may travel.

7. The intermittent gas injection optimization system of claim 4, wherein the compressor is a well site compressor residing proximate the gas storage vessel and is configured to pump the compressible fluid through the inlet and into the gas storage vessel.

8. The intermittent gas injection optimization system of claim 7, wherein the well site compressor is configured to receive control signals from the controller and (i) discontinue injection of gas into the gas storage vessel or (ii) bypass the gas storage vessel inlet, if pressure readings within the gas storage vessel reach a pre-set critical pressure point.

9. The intermittent gas injection optimization system of claim 7, wherein the well site compressor is further configured to receive control signals that control the operating speed of the well site compressor to adjust a fillage rate of gas through the inlet and into the gas storage vessel.

10. The intermittent gas injection optimization system of claim 9, wherein the controller is configured to increase the operating speed of the well site compressor when a calculated pressure differential between the production tubing and the annular region is greater than a previous ΔP.

11. The intermittent gas injection optimization system of claim 4, wherein the compressor is a facilities compressor residing remote from the wellbore;

and the system further comprises:

a gas service line running from the facilities compressor to the gas storage vessel; and a vessel in-flow control valve residing along the gas service line;

and wherein the vessel in-flow control valve is configured to receive control signals from the controller to adjust a flow of compressible fluids through the inlet line and into the gas storage vessel.

12. The intermittent gas injection optimization system of claim 11, wherein (i) the in-flow control valve is configured to at least partially close or (ii) the flow control valve is configured to open, if pressure readings within the gas storage vessel reach a pre-set critical set point.

13. The intermittent gas injection optimization system of claim 4, wherein the controller is configured to:

cycle the well flow control valve between a vessel loading stage where compressible fluid is loaded into the gas storage vessel, and a wellbore injection stage where the compressible fluid is injected into the annular region;

adjust a pre-determined pressure set point range in response to ΔP calculations, thereby tuning ($V_R$) to ($V_S$) with each vessel loading stage; and if (ΔP) remains too high during a wellbore injection stage, increase a rate of vessel fillage during a next vessel loading stage.

14. The intermittent gas injection optimization system of claim 13, wherein the controller is configured to calculate a rise ($\Delta P_C$) in casing pressure and a rate of volume increase (dV/dy) of gas in the gas storage vessel while the volume of gas ($V_R$) is accumulating in the gas storage vessel.

15. A method of optimizing gas injection for an artificial lift system, comprising:

providing a wellbore, the wellbore having a production tubing extending from a surface down to a selected subsurface formation, and an annular region around the production tubing;

providing a gas storage vessel at the surface, the gas storage vessel comprising an inlet for receiving a compressible fluid, and an outlet for releasing the compressible fluid as an injection gas;

providing a gas compressor configured to inject the compressible fluid through the inlet and into the gas storage vessel as a working gas;

providing a first pressure transducer associated with the gas storage vessel;

providing a second pressure transducer configured to determine pressure in the production tubing, and to send signals ($S_2$) in real time;

providing a third pressure transducer configured to determine pressure in the annular region, and to send signals ($S_3$) in real time;

providing a well flow control valve positioned between the outlet for the gas storage vessel and the annular region;

providing a controller configured to receive pressure value signals ($S_1$), ($S_2$) and ($S_3$);

producing hydrocarbon fluids through the production tubing and up to the surface;

receiving signals ($S_1$) at the controller from the first pressure transducer in real time, and associating the signals ($S_1$) with gas volume within the gas storage vessel; and intermittently releasing a volume of working gas ($V_R$) from the gas storage vessel and into the annular region, wherein ($V_R$) is tuned to lift a volume of fluids ($V_S$) that has accumulated within the tubing string during production.

16. The method of claim 15, further comprising:

using the controller receiving pressure value signals ($S_1$), ($S_2$) and ($S_3$), and in response, sending control signals that cyclically open and close the well flow control valve to provide for an intermittent release of ($V_R$), wherein:

(i) when the well flow control valve is closed, compressible fluid is directed through the inlet to pressurize the gas storage vessel, and (ii) when the well flow control valve is opened, working gas is injected into the annular region as ($V_R$).

17. The method of claim 16, further comprising:

providing a gas injection line configured to inject the working gas into the annular region, wherein the well flow control valve is in fluid communication with both the gas injection line and the outlet of the gas storage vessel during the production of hydrocarbon fluids through the production tubing.

18. The method of claim 17, further comprising:

using the controller, calculating a pressure differential between (i) pressure readings taken by the second transducer and (ii) pressure readings taken by the third transducer, as ΔP, in real time;

correlating ΔP values to the volume of liquid ($V_S$) present within the tubing string during production; and tuning ($V_R$) according to ($V_S$) based on ΔP such that ($V_R$) is adequate to remove ($V_S$).

19. The method of claim 18, wherein further comprising:

using the controller, correlating pressure readings taken by the first transducer to a volume of compressible fluid present within the gas storage vessel, in real time; and controlling an amount of compressible fluid pumped through the inlet and into the gas storage vessel when the well flow control valve is closed to receive the volume of working gas ($V_R$).

20. The method of claim 19, wherein a packer resides at a lower end of the production tubing, and provides a seal of the annular region, and wherein the packer comprises a gas-lift valve providing a check valve through which injected gas may travel.

21. The method of claim 19, wherein the annular region is (i) a space defined between the tubing string and the surrounding string of casing, (ii) an injection line residing within the wellbore and along the tubing string, or (iii) a combination thereof.

22. The method of claim 19, wherein the compressor is a well site compressor that resides proximate the gas storage vessel.

23. The method of claim 22, wherein the well site compressor is configured to receive control signals from the controller and (i) discontinue injection of gas into the gas storage vessel or (ii) bypass the injection of gas into the gas storage vessel, if pressure readings within the gas storage vessel reach a pre-set critical set point when the flow control valve is in a closed position.

24. The method of claim 22 wherein the well site compressor is configured to receive control signals that control an operating speed of the well site compressor to adjust a Pillage rate of gas through the inlet and into the gas storage vessel.

25. The method of claim 24, wherein controlling the operating speed comprises increasing an operating speed of the well site compressor when ΔP is determined by the controller to be greater than a previous ΔP.

26. The method of claim 24, wherein when the well flow control valve is opened, the well site compressor is operated for a period of time at a speed that injects gas into the gas storage vessel and then into the annular region as ($V_R$) to provide critical flow within the production tubing.

27. The method of claim 16, wherein:

the compressor is a facilities compressor residing remote from the wellbore, wherein the compressor pumps the compressible fluid to the inlet via a gas service line; and the method further comprises providing a vessel in-flow control valve along the gas service line, wherein the vessel in-flow control valve is configured to receive control signals from the controller to adjust a flow of compressible fluids through the inlet line and into the gas storage vessel so as to adjust the volume of working gas ($V_R$) flowing into the gas storage vessel when the well flow control valve is closed.

28. The method of claim 27, further comprising:

increasing the opening in the control valve when ΔP is determined by the controller to be less than a desired ΔP.

29. The method of claim 27, wherein the flow control valve is configured to receive control signals from the controller to move into a closed position and to discontinue injection of compressible fluids into the gas storage vessel when (i) a rate of pressure decline within the gas storage vessel has reached a pre-set range, or (ii) the injection rate of compressible fluids has dropped below a rate that provided a critical flow within the production tubing.

30. The method of claim 19, wherein the wellbore is completed horizontally.

31. The method of claim 19, further comprising:

determining a geometry of the gas storage vessel; and determining a geometry of the annular region.

32. The method of claim 19, wherein the controller is further configured to calculate a rise ($\Delta P_C$) in casing pressure and a rate of volume increase (dV/dy) of gas in the gas storage vessel while the volume of gas ($V_R$) is accumulated in the gas storage vessel.

33. A surface gas injection system for providing intermittent gas injection into a wellbore, comprising:

a gas storage vessel residing at a surface, the gas storage vessel comprising an inlet for receiving a compressible fluid from a compressor, and an outlet for releasing the compressible fluid as an injection gas;

a gas injection line configured to inject the injection gas from the gas storage vessel and into an annular region within the wellbore;

a well flow control valve positioned between the outlet for the gas storage vessel and the wellbore, and in fluid communication with the gas injection line; and a controller configured to send control signals that cyclically open and close the well flow control valve wherein:

(i) when the well flow control valve is open, a volume of injection gas ($V_R$) is released from the gas storage vessel, through the well flow control valve and into the annular region to lift a volume of fluids ($V_S$) residing in a production tubing to the surface;

(ii) after the well flow control valve has been opened, the controller monitors pressure drop in the annular region and determines that liquids in the production tubing have been substantially displaced to the surface;

(iii) when the well flow control valve is closed, compressible fluid is directed through the inlet to re-pressurize the gas storage vessel;

(iv) a rate of fillage for the gas storage vessel is adjusted to provide that a suitable volume of compressible fluid is injected into the gas storage vessel by the compressor to provide ($V_R$) before the well flow control valve is re-opened; and (iv) upon determining that liquids in the production tubing have been substantially displaced to the surface, opening the well flow control valve to release ($V_R$).

34. The surface gas injection system of claim 33, further comprising:

a first pressure transducer configured to determine pressure in the production tubing;

a second pressure transducer configured to determine pressure in the annular region as formed between the production tubing and a surrounding casing string;

a third pressure transducer configured to determine pressure in the gas storage vessel;

and wherein the controller is further configured to:

correlate pressure readings taken by the third transducer to the volume of compressible fluid present within the gas storage vessel, in real time; and tune ($V_R$) according to ($V_S$) during production such that ($V_R$) is adequate to remove ($V_S$).

* * * * *